US009161880B2

(12) United States Patent
Ashihara et al.

(10) Patent No.: US 9,161,880 B2
(45) Date of Patent: Oct. 20, 2015

(54) WALKING ASSIST DEVICE

(75) Inventors: Jun Ashihara, Wako (JP); Yoshihisa Matsuoka, Tochigi (JP); Hiroshi Matsuda, Wako (JP); Yutaka Hiki, Wako (JP); Makoto Shishido, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 1063 days.

(21) Appl. No.: 13/146,519

(22) PCT Filed: Jan. 19, 2010

(86) PCT No.: PCT/JP2010/050535

§ 371 (c)(1),
(2), (4) Date: Jul. 27, 2011

(87) PCT Pub. No.: WO2010/087245

PCT Pub. Date: Aug. 5, 2010

(65) Prior Publication Data

US 2011/0306907 A1 Dec. 15, 2011

(30) Foreign Application Priority Data

Jan. 29, 2009 (JP) ..... 2009-018291
Dec. 18, 2009 (JP) ..... 2009-287917

(51) Int. Cl.
*A61H 3/00* (2006.01)

(52) U.S. Cl.
CPC ..... *A61H 3/008* (2013.01); *A61H 3/00* (2013.01); *A61H 2201/1215* (2013.01); *A61H 2201/149* (2013.01); *A61H 2201/1436* (2013.01); *A61H 2201/165* (2013.01); *A61H 2201/1623* (2013.01); *A61H 2201/1633* (2013.01); *A61H 2201/1635* (2013.01); *A61H 2201/1642* (2013.01); *A61H 2201/1676* (2013.01); *A61H 2201/5007* (2013.01); *A61H 2201/5061* (2013.01); *A61H 2201/5071* (2013.01)

(58) Field of Classification Search
CPC ..... A61H 1/00; A61H 1/02; A61H 1/0211; A61H 1/0237; A61H 1/024; A61H 1/0244; A61H 1/0255; A61H 1/0267; A61H 3/00; A61H 2003/007; A61H 2201/0157; A61H 2201/12; A61H 2201/1207; A61H 2201/1215; A61H 2201/1292; A61H 2201/1418; A61H 2201/1436; A61H 2201/149; A61H 2201/1628; A61H 2201/163; A61H 2201/1633; A61H 2201/164; A61H 2203/04; A61H 2203/0406; A61H 2205/088; A61H 2201/10
USPC ..... 601/5, 23, 27, 29, 31–38
See application file for complete search history.

(56) References Cited

U.S. PATENT DOCUMENTS

2008/0009778 A1* 1/2008 Hiki ..... 602/16

FOREIGN PATENT DOCUMENTS

JP 2007-020909 2/2007
JP 2008-012224 1/2008

OTHER PUBLICATIONS

Japanese Office Action with pertinent English translation dated Oct. 9, 2013, 3 pages.
German Office Action and Translation, 10 pages.

* cited by examiner

*Primary Examiner* — Rachel Young
*Assistant Examiner* — Michael Tsai
(74) *Attorney, Agent, or Firm* — Rankin, Hill & Clark LLP

(57) ABSTRACT

In a walking assist device having leg links each connected to a support member through a first joint and having a first link and second link connected to the first link through a second joint, and actuators to be operated to displace the first and second links relative to each other to produce assist forces that assist part of user's body weight to assist the user to walk, it is configured such that a forward protruding amount of the second joint to be protruded with change of an angle between the first and second links about the second joint is changed. With this, it becomes possible to decrease the forward protruding amount to be protruded from the trunk of the user with change of the angle about the second joint, thereby decreasing the inertia force about the vertical axis, while mitigating the unnatural impression of the appearance.

2 Claims, 27 Drawing Sheets

WALKING ASSIST DEVICE

TECHNICAL FIELD

This invention relates to a walking assist device, more particularly to a walking assist device attached to the lower body of a user to assist his/her walk, which device can decrease protruding amounts of device knee joints of the device.

BACKGROUND ART

Recently known walking assist devices for assisting user's walk include, for instance, the one according to the technology set out in Patent Reference 1 below.

The walking assist device of the Patent Reference 1 is equipped with a support member capable of supporting the user and transmitting his/her body weight or load, shoe units capable of accommodating the user's feet, leg links having first links (thigh links) connected to the support member through joints corresponding to the hip joints to be swingable about a fulcrum and second links (shank links) connected to the shoe units and also connected to the first links through joints corresponding to the knee joints, and actuators connected to the first links and second links, and when the user is supported by the support member, the actuator is operated to displace the first links and second links relative to each other to produce assist forces that assist or bear at least part of the user's weight, thereby assisting the user's walk.

PRIOR ART REFERENCE

Patent Reference

Patent Reference 1: Japanese Laid-Open Patent Application 2007-20909

SUMMARY OF INVENTION

Problems to be Solved by the Invention

In the walking assist device of the Patent Reference 1, the configuration as above has an advantage that, for instance, the difference in body height of the user can be absorbed by adjusting angles of the device joints corresponding to the knee joints, whilst having a disadvantage that since the device joints are protruded forward from the trunk of the user, an inertia force about the vertical axis is increased and also the appearance gives unnatural impression.

The object of this invention is therefore to overcome this problem by providing an walking assist device that can decrease forward protruding amounts of the device joints corresponding to the knee joints from the trunk of the user.

Means for Solving the Problems

In order to achieve the object, according to one aspect, this invention is configured to have a walking assist device having a support member adapted to support a user and transmit user's body weight, a pair of leg links each connected to the support member through a first joint constituted of a swing mechanism to be swingable about a swing fulcrum and having a first link and a second link connected to the first link through a second joint, and actuators, each of the actuators being operated to displace the first link and the second link relative to each other to produce an assist force that assists at least part of the user's body weight so as to assist the user to walk, characterized in that: a forward protruding amount of the second joint to be protruded with change of an angle between the first link and the second link about the second joint is changed.

As recited in the walking assist device recited in claim 2 mentioned below, the device further includes a length reducing mechanism adapted to reduce length from the second joint to the swing fulcrum as the angle between the first link and the second link about the second joint is decreased, such that the forward protruding amount of the second joint to be protruded with change of the angle between the first link and the second link about the second joint is changed.

According to another aspect, the first joint includes an arc-shaped guide rail fastened to the support member and having its center of curvature at the swing fulcrum and a slider movably engaged with the guide rail, the leg link is connected to the support member to be swingable about the center of curvature of the guide rail, and the actuator is connected to a connecting rod interconnecting the first joint and the second link in the first link.

According to another aspect, the length reducing mechanism includes a slider gear fastened to the slider, a link gear meshed with the slider gear and connected to the actuator, and a rocker arm fastened at its one end with the link gear and rotatably connected at its other end to the connecting rod, and the link gear is driven by the actuator to rotate the rocker arm to move the connecting rod backward such that the length from the second joint to the swing fulcrum is reduced.

According to another aspect, number of teeth of the slider gear is larger than that of the link gear.

According to another aspect, the length reducing mechanism includes one of components of a worm gear mechanism having a worm and a gear fastened to the slider and other thereof fastened to the connecting rod and also connected to the actuator, and the other is driven by the actuator to move the connecting rod backward such that the length from the second joint to the swing fulcrum is reduced.

According to another aspect, the length reducing mechanism includes a guide formed on the slider and a second slider movably engaged with the guide and also fastened to the connecting rod, and the second slider is driven by the actuator to move the connecting rod backward such that the length from the second joint to the swing fulcrum is reduced.

According to another aspect, the length reducing mechanism includes a link mechanism movably connecting the slider with the connecting rod, and the link mechanism is driven by the actuator to move the connecting rod backward such that the length from the second joint to the swing fulcrum is reduced.

According to another aspect, the leg link includes a third link connected to the first joint, and the third link and the first link are interconnected by a third joint to be movable relative to each other, such that the forward protruding amount of the second joint to be protruded with change of the angle between the first link and the second link about the second joint is changed.

As recited in the walking assist device recited in claim 10 mentioned below, movement of the second joint describes trajectory having at least one inflection point as viewed from side when the actuator is operated to displace the first link and second link relative to each other.

According to another aspect, length from the second joint to the swing fulcrum is changed in line with trajectory having nonlinear characteristics as viewed from side as the angle between the first link and the second link about the second joint is decreased when the actuator is operated to displace the first link and second link relative to each other.

According to another aspect, the device further includes a fourth link connected to the first link and a fifth link connected at its one end to the fourth link and at other end to the third link, and a quadric-link mechanism constituted of the first, third, fourth and fifth links is driven by the actuator.

According to another aspect, the quadric-link mechanism establishes a dead point at which at least three of kinematic pair points are positioned in a straight line.

As recited in the walking assist device recited in claim 14 mentioned below, a drive force of the actuator is distributed to the first link and the second link to drive them.

According to another aspect, the second link is connected to a second quadric-link mechanism and the drive force of the actuator is distributed to the second link through the second quadric-link mechanism.

According to another aspect, the second link is connected to a chain mechanism and the drive force of the actuator is distributed to the second link through the chain mechanism.

According to another aspect, the second quadric-link mechanism shares at least one of kinematic pair points with the first quadric-link mechanism.

Effects of the Invention

According to one aspect, it is configured to have a walking assist device having a support member adapted to support a user and transmit user's body weight, a pair of leg links each connected to the support member through a first joint constituted of a swing mechanism to be swingable about a swing fulcrum and having a first link and a second link connected to the first link through a second joint, and actuators, each of the actuators being operated to displace the first link and the second link relative to each other to produce an assist force that assists at least part of the user's body weight so as to assist the user to walk, characterized in that: a forward protruding amount of the second joint to be protruded with change of an angle between the first link and the second link about the second joint is changed. With this, where the second joint is corresponding to the knee joint, it becomes possible to change, i.e., decrease the forward protruding amount of the second joint to be protruded from the trunk of the user with change of the angle about the second joint, thereby decreasing the inertia force about the vertical axis, while mitigating the unnatural impression of the appearance.

In claim 2, the device further includes a length reducing mechanism adapted to reduce length from the second joint to the swing fulcrum as the angle between the first link and the second link about the second joint is decreased, such that the forward protruding amount of the second joint to be protruded with change of the angle between the first link and the second link about the second joint is changed. With this, where the second joint is corresponding to the knee joint, since the forward protruding amount of the second joint from the trunk of the user is appropriately changed, it becomes possible to decrease the forward protruding amount of the second joint from the trunk of the user accordingly, thereby decreasing the inertia force about the vertical axis, while mitigating the unnatural impression of the appearance.

According to another aspect, the first joint includes an arc-shaped guide rail fastened to the support member and having its center of curvature at the swing fulcrum and a slider movably engaged with the guide rail, the leg link is connected to the support member to be swingable about the center of curvature of the guide rail, and the actuator is connected to a connecting rod interconnecting the first joint and the second link in the first link. With this, in addition to the foregoing effects, it becomes possible to effectively absorb the difference in body height of the user by adjusting the angle of the second joint corresponding to the knee joint.

According to another aspect, the length reducing mechanism includes a slider gear fastened to the slider, a link gear meshed with the slider gear and connected to the actuator, and a rocker arm fastened at its one end with the link gear and rotatably connected at its other end to the connecting rod 46, and the link gear is driven by the actuator to rotate the rocker arm to move the connecting rod backward such that the length from the second joint to the swing fulcrum is reduced. With this, in addition to the foregoing effects, the structure can be made simple.

According to another aspect, number of teeth of the slider gear is larger than that of the link gear. With this, in addition to the foregoing effects, it becomes possible to reduce speed to amplify torque and it can make the actuator compact.

According to another aspect, the length reducing mechanism includes one of components of a worm gear mechanism having a worm and a gear fastened to the slider and other thereof fastened to the connecting rod and also connected to the actuator, and the other is driven by the actuator to move the connecting rod backward such that the length from the second joint to the swing fulcrum is reduced. With this, in addition to the foregoing effects, the forward protruding amount of the third joint from the trunk of the user can be decreased more smoothly.

According to another aspect, the length reducing mechanism includes a guide formed on the slider and a second slider movably engaged with the guide and also fastened to the connecting rod, and the second slider is driven by the actuator to move the connecting rod backward such that the length from the second joint to the swing fulcrum is reduced. With this, in addition to the foregoing effects, since no gear is used, this configuration can decrease friction.

According to another aspect, the length reducing mechanism includes a link mechanism movably connecting the slider with the connecting rod, and the link mechanism is driven by the actuator to move the connecting rod backward such that the length from the second joint to the swing fulcrum is reduced. With this, in addition to the foregoing effects, since no gear is used, this configuration can decrease friction.

According to another aspect, the leg link includes a third link connected to the first joint, and the third link and the first link are interconnected by a third joint to be movable relative to each other, such that the forward protruding amount of the second joint to be protruded with change of the angle between the first link and the second link about the second joint is changed. With this, where the second joint is corresponding to the knee joint, when a positional relationship among the third link and other components is appropriately set, the length or distance from the swing fulcrum to the knee joint can be changed and hence, it becomes possible to decrease the forward protruding amount of the device knee joint from the trunk of the user, thereby decreasing the inertia force about the vertical axis, avoiding the interference with surrounding members and also mitigating the unnatural impression of the appearance.

Specifically, since the third link and first link are interconnected by the third joint to be movable relative to each other, when the third joint is driven, the length or distance from the swing fulcrum to the end of the leg link can be increased with increasing angle of the second joint. As a result, it becomes possible to ensure the large angle of the second joint at the time when the user stands upright and hence, the forward protruding amount of the device knee joint from the trunk of the user can be decreased.

In claim 10, movement of the second joint describes trajectory having at least one inflection point as viewed from side when the actuator is operated to displace the first link and second link relative to each other. With this, in addition to the foregoing effects, since the trajectory is appropriately set, the length or distance from the swing fulcrum to the end of the leg link can be increased with increasing angle of the second joint. As a result, it becomes possible to ensure the further large angle of the second joint at the time when the user stands upright.

According to another aspect, length from the second joint to the swing fulcrum is changed in line with trajectory having nonlinear characteristics as viewed from side as the angle between the first link and the second link about the second joint is decreased when the actuator is operated to displace the first link and second link relative to each other. With this, in addition to the foregoing effects, since the trajectory is appropriately set, similarly the length or distance from the swing fulcrum to the end of the leg link can be increased with increasing angle of the second joint. As a result, it becomes possible to ensure the further large angle of the second joint at the time when the user stands upright.

According to another aspect, the device further includes a fourth link connected to the first link and a fifth link connected at its one end to the fourth link and at other end to the third link, and a quadric-link mechanism constituted of the first, third, fourth and fifth links is driven by the actuator. With this, in addition to the foregoing effects, since the length of the links constituting the first quadric-link mechanism are appropriately set, it enables the input/output characteristics of the first quadric-link mechanism to exhibit the curve characteristics, thereby achieving the smooth movement of the leg link.

According to another aspect, the quadric-link mechanism establishes a dead point at which at least three of kinematic pair points are positioned in a straight line. With this, in addition to the foregoing effects, it becomes possible to more effectively decrease the forward protruding amount of the device knee joint of when (before/after) the user's knee is fully extended.

According to another aspect, a drive force of the actuator is distributed to the first link and the second link to drive them. With this, in addition to the foregoing effects, the installment of only one motor suffices, thereby achieving the simple and light structure.

According to another aspect, the second link is connected to a second quadric-link mechanism and the drive force of the actuator is distributed to the second link through the second quadric-link mechanism. With this, in addition to the foregoing effects, since the length of the links constituting the second quadric-link mechanism are appropriately set, it enables the input/output characteristics of the second quadric-link mechanism to exhibit the curve characteristics, thereby achieving the further smooth movement of the leg link.

According to another aspect, the second link is connected to a chain mechanism and the drive force of the actuator is distributed to the second link through the chain mechanism. With this, in addition to the foregoing effects, it is not necessary to take into account the intrinsic risk of the link mechanism like buckling, while the second link can be displaced relative to the first link more than 180 degrees, so that freedom of design can be enhanced.

According to another aspect, the second quadric-link mechanism shares at least one of kinematic pair points with the first quadric-link mechanism. With this, in addition to the foregoing effects, it becomes possible to make the structure simple due to the shared kinematic pair point.

DESCRIPTION OF EMBODIMENTS

Embodiments for carrying out a walking assist device according to the present invention will now be explained with reference to the attached drawings.

First Embodiment

Figure 1:
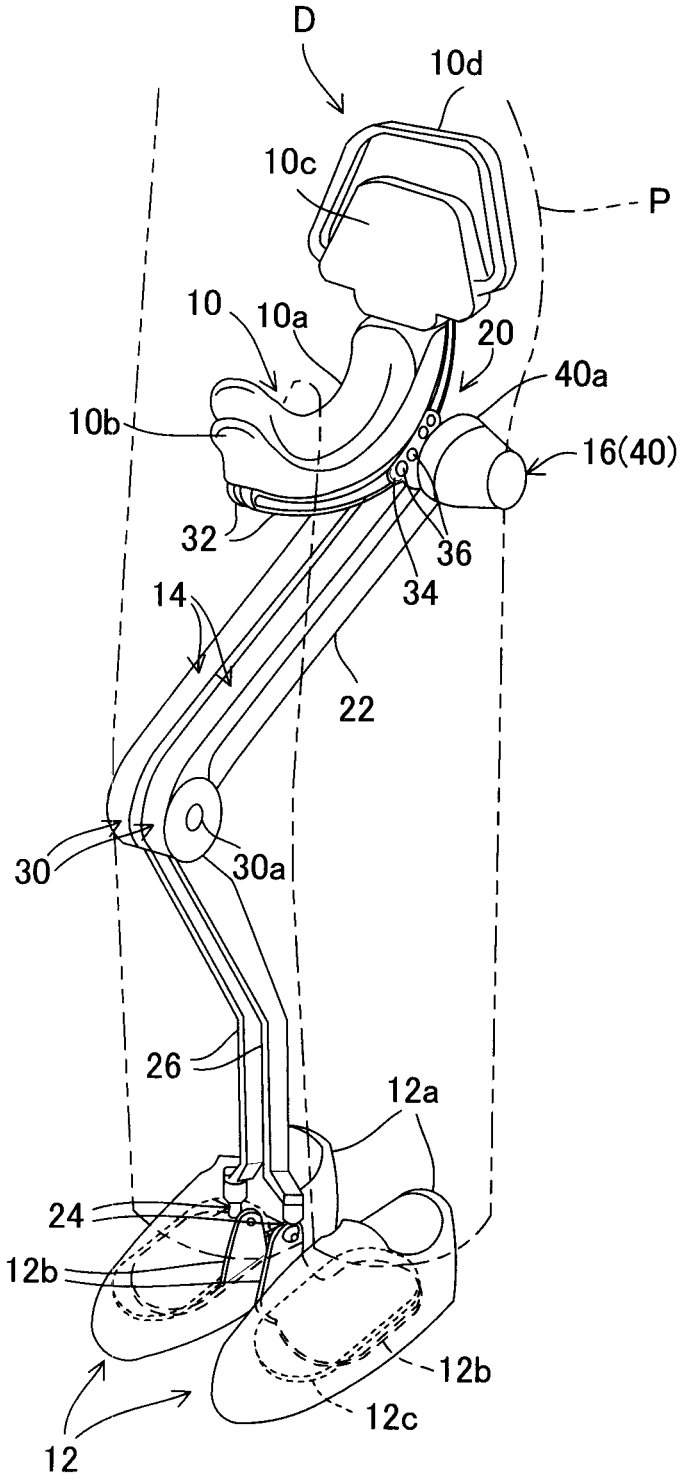
FIG. 1 is a perspective view of a walking assist device according to a first embodiment of the invention.
Figure 2:
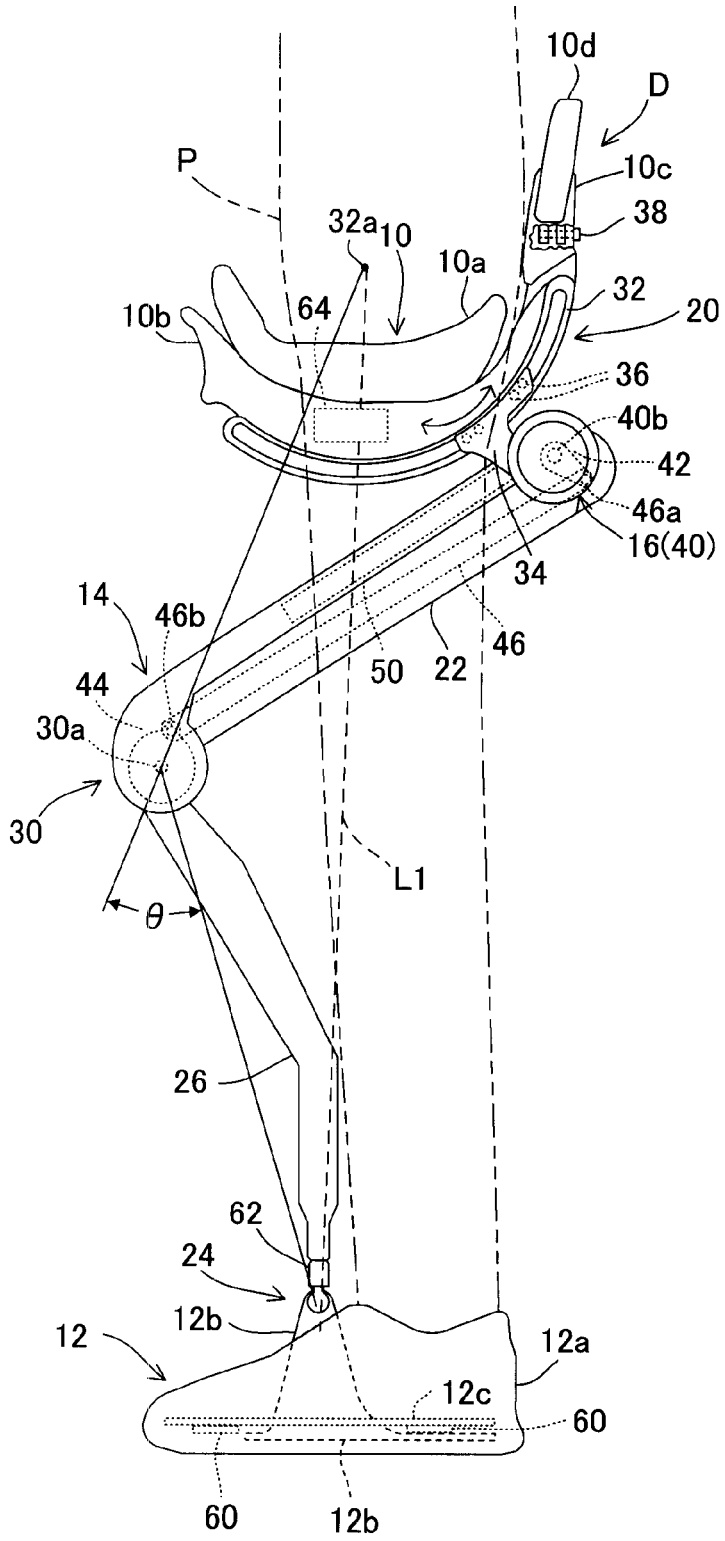
FIG. 2 is a side view of the device shown in FIG. 1.
Figure 3:
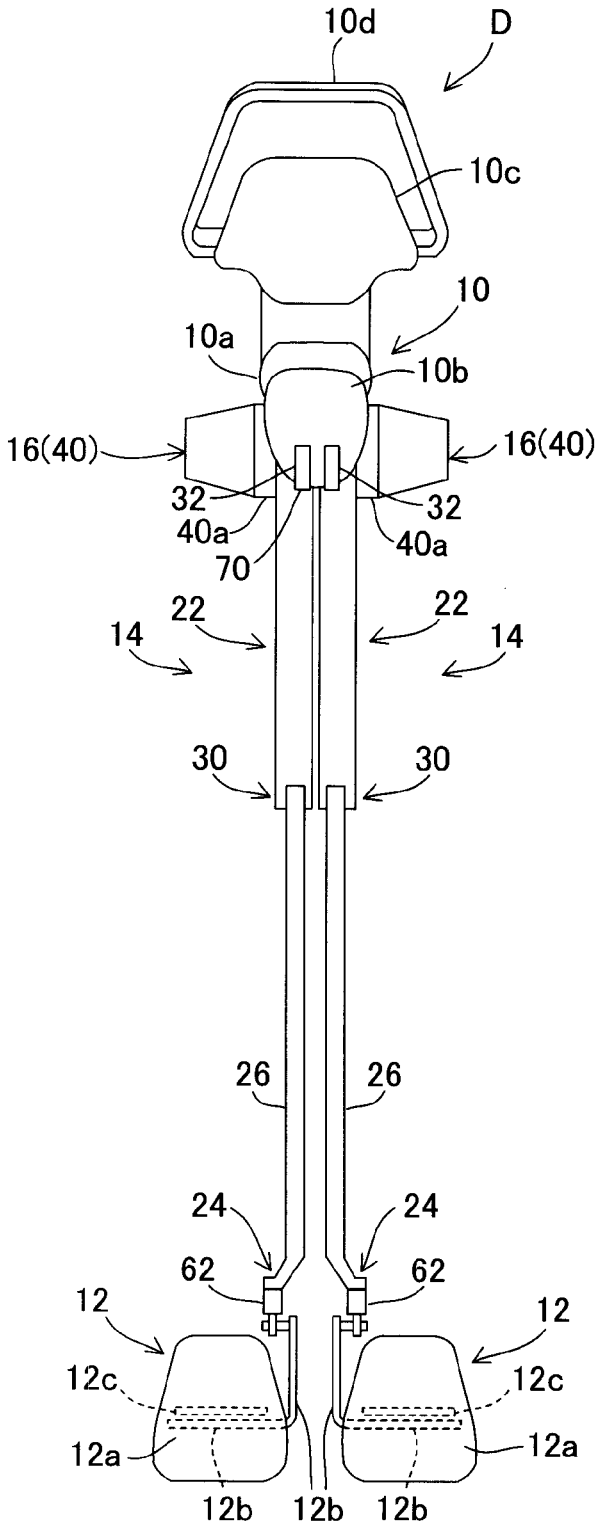
FIG. 3 is a front view of the device shown in FIG. 1.

FIG. 1 is a perspective view of a walking assist device according to a first embodiment of the invention, FIG. 2 is a side view thereof and FIG. 3 is a front view thereof.

The explanation will be made with reference to FIGS. 1 to 3. The walking assist device D comprises a support member (load transmitting member) 10 adapted to support a user (person) P seated astraddle thereon, a pair of left and right shoe units 12 to be worn on the left and right feet of the user, a pair of left and right leg links 14 provided between the support member 10 and the shoe units 12, and drive mechanisms 16. The walking assist device D is fastened to the lower body of the user P by a belt (not shown) provided on the support member 10 to assist the user P's walk.

The left and right leg links 14 are made of aluminum. Each comprises a first link (thigh link) 22 connected to the support member 10 through a first joint 20 (corresponding to the human hip joint), a second link (shank link) 26 connected to the associated shoe unit 12 through a second joint 24 (corresponding to the human ankle joint), and a third joint 30 (corresponding to the human knee joint) interconnecting the first link 22 and second link 26.

The first link 22 and second link 26 of the leg link 14 are connected to the associated drive mechanism 16 which moves (drives) them relative to each other with the third joint 30, more precisely, a joint shaft 30*a* thereof as a fulcrum.

The support member 10 comprises a saddle-type seat 10*a* on which the user P can be seated astraddle, a support frame 10*b* located near the seat 10*a* to support it, and a back rest 10*c* rising from the support frame 10*b* to above the rear end (as viewed by the user P) of the seat 10*a* to contact the lower back of the user P. A grip 10*d* that can be grasped by the user P is attached to the back rest 10*c*.

The seat 10*a* is made of a cushioning material, and the support frame 10*b* and back rest 10*c* are made of materials of higher rigidity than the seat 10*a*.

A swing mechanism of the first joint 20 connecting the leg link 14 and support member 10 comprises an arc-shaped guide rail 32 fastened to the support member 10 and a slider 34 that engages with the guide rail 32 and is fixed to one end of the associated leg link 14. Although the guide rail 32 on the left side is only shown in FIG. 2, as shown in FIG. 3, the guide rail 32 and slider 34 are provided also on the right side. The guide rails 32 and sliders 34 are made of aluminum.

A plurality of rollers 36 are attached to each slider 34. The rollers 36 are fitted in a groove formed in the guide rail 32 to roll along the groove. Therefore, as indicated by an arrow in FIG. 2, each slider 34 engages with the associated guide rail 32 to be movable along it.

In other words, each leg link 14 is configured such that it can swing about the center of curvature 32*a* (swing fulcrum (supporting point)) of the associated guide rail 32 in the longitudinal direction of the support member 10. Further, the guide rails 32 are pivotally supported on the back rest 10*c* of the support member 10 by a support shaft 38 installed to extend in the longitudinal direction of the support member 10 and hence, they can swing about the support shaft 38 in the lateral direction of the support member 10.

Thus the leg links 14 are configured such that they can swing forward and backward (in the traveling direction of the user P) about the centers of curvature 32*a* of the guide rails 32 as the swing fulcrums. Therefore, when the point of action of the upper body weight (load) of the user P relative to the support member 10 shifts forward of the swing fulcrum 32*a* to make the support member 10 descend forward, since the swing fulcrum 32*a* is located above the support member 10 in the direction of gravity, the point of action of the body weight is displaced rearward below the swing fulcrum 32*a*, thereby shortening the fore-aft distance between the swing fulcrum 32*a* and the point of action of the body weight to reduce rotational moment acting on the support member 10.

Then when the point of action of the body weight has moved as far as directly under the swing fulcrum 32*a*, the rotational moment acting on the support member 10 becomes zero and the support member 10 becomes stable. Thus, since the support member 10 converges on the stable state by itself, the support member 10 does not shift forward or backward at the location of the user P's crotch.

The guide rails 32 are enabled to swing sideways (relative to the traveling direction of the user P) about the swing fulcrum (support shaft) 38, so that the leg links 14 can swing sideways to make it possible for the user P to swing the legs outward at will.

Each of the shoe units 12 comprises a shoe 12*a* to be worn on a foot of the user P, an L-shaped (as viewed from the front looking rearward along the path of user P travel) connecting member 12*b* made of carbon material and installed in the shoe 12*a* for enabling the corresponding foot of the user P to rest thereon, and an insole 12*c* of urethane rubber or similar rubbery elastic material that lies on the upper surface of the connecting member 12*b*. The second link 26 of each leg link 14 is connected to the associated connecting member 12*b* through the associated second joint 24 of triaxial structure.

Figure 4:
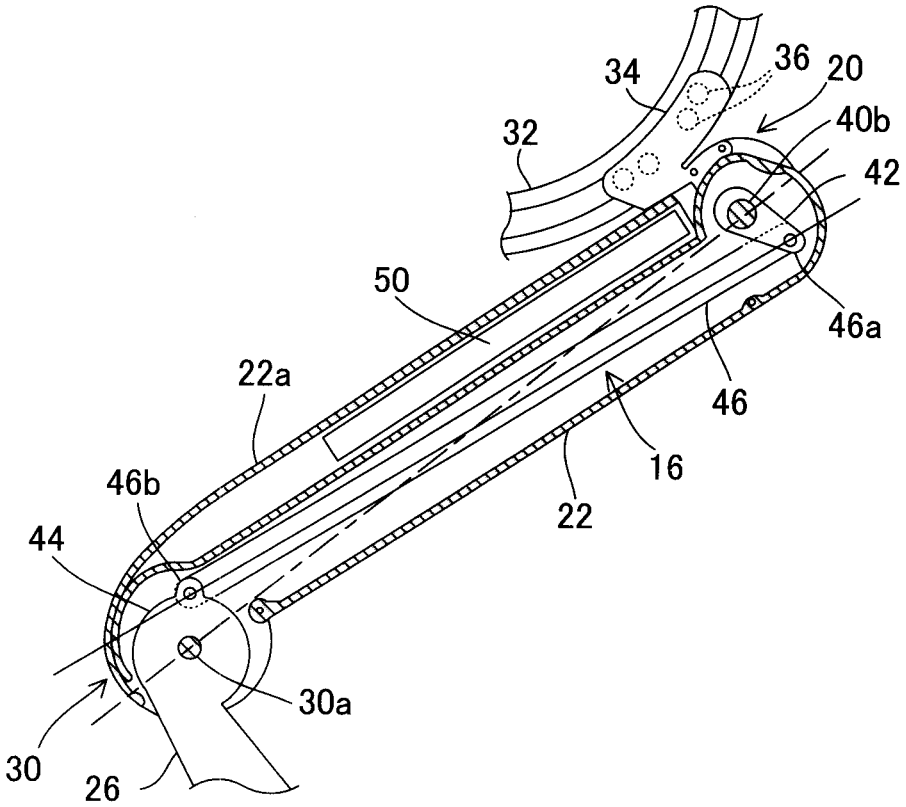
FIG. 4 is a side sectional view of a drive mechanism, first link and other components shown in FIG. 1, etc.

FIG. 4 is a side sectional view of each drive mechanism 16 and the associated first link 22, etc.

The drive mechanism 16 comprises an actuator (electric motor) 40 located near an end of the first link 22, an output shaft 40*b* outputting the rotation of the actuator 40 reduced in speed through a speed reducer 40*a* (shown in FIG. 3), a rocker arm (drive crank arm) 42 fastened to the output shaft 42*b*, a driven crank arm 44 fastened to the second link 26 coaxially with the joint shaft 30*a* of the third joint 30, and a connecting rod 46 interconnecting the rocker arm 42 and driven crank arm 44, i.e., connected to the actuator 40, while interconnecting the first joint 20 and second link 26. Thus, to be specific, the first link 22 is constituted as a quadric-link mechanism comprising the first link 22, rocker arm 42, driven crank arm 44 and connecting rod 46.

More specifically, the first link 22 having a hollow structure accommodates the connecting rod 46 therein. The connecting rod 46 is attached at its one end to the rocker arm 42 by a pivot 46*a* and at the other end to the driven crank arm 44 by a pivot 46*b*, thereby establishing rotatable connections.

As shown in FIG. 4, the first link 22 is disposed so that a line drawn to connect the pivot 46*a* where the connecting rod 46 is attached to the drive crank arm 42 with the pivot 46*b* where it is attached to the driven crank arm 44 intersects a line drawn to connect the output shaft 40*b* of the actuator 40 with the joint shaft 30*a* of the third joint 30. A battery case 22*a* is attached to the first link 22 to accommodate a battery 50 that supplies power for operating the actuator 40 and the like.

The walking assist control for assisting the user P's walk will be explained next.

As shown in FIG. 2, each shoe unit 12 is provided on the undersurface of its insole 12*c* with a pair of front and rear single-axis force sensors 60 that produce outputs proportional to the loads (pressure) acting at the middle toe (MP (metacarpophalangeal) joint) region and heel region of the user P's foot. In addition, each second joint 24 incorporates a biaxial force sensor 62 that produces an output proportional to the force acting on the second joint 24 (resultant of the forces produced by the weights of the support member 10 and the associated leg link 14).

The outputs of the sensors 60 and 62 are sent to a controller 64 housed in the support frame 10*b* of the support member 10. The controller 64 comprises a microcomputer equipped with a CPU, ROM, RAM and input-output (I/O) ports, and executes assist control for producing assist forces that assist the user P's walk.

More specifically, the controller 64 multiplies the value of the assist forces set in advance by a proportion of the total load acting on the feet of the user P that is borne by the individual feet calculated from the outputs of the force sensors 60, and defines the obtained products as desired values of the assist forces to be produced in the respective leg links 14. For example, where the load (weight) of the device D is 60 (N) and the assist force is 30 (N), the set value will be 90 (N).

Each assist force acts along the line in FIG. 2 (designated L1; hereinafter sometimes called "reference line") that interconnects the fore-aft swing fulcrum 32*a* of the leg link 14 in the first joint 20 and the fore-aft swing fulcrum of the leg link 14 in the second joint 24. So the controller 64 detects the actual assist force acting along the reference line L1 based on the output of the force sensor 62 and controls the operation of the drive mechanisms 16 to make the detected actual assist force equal to the desired value.

More specifically, when the user P is supported as seated on the seat 10*a* of the support member 10, the controller 64 operates the actuators 40 of the drive mechanisms 16 to produce relative movement between the first links 22 and the second links 26 of the leg links 14 about the joint shafts 30*a* of the third joints 30 through the connecting rods 46, thereby helping the user P walk by producing supporting forces, i.e., assist forces, to support at least part of the user P's body weight.

The assist forces produced in the leg links 14 are transmitted through the support member 10 to the trunk of the user P to assist his/her walking by reducing the load acting on the legs of the user P. The user P is presumed to be a worker at a factory or the like who works in a standing posture.

Thus the walking assist device D is configured to include the support member 10 capable of supporting the user P to transmit the user's body weight or load, the leg links 14 connected to the support member 10 to be swingable about the swing fulcrum 32*a* through the first joints 20 constituted as the swing mechanism and having the first links 22 and the second links 26 connected to the first links 22 through the third joints (second joints) 30, and the electric motors (actuator) 40, wherein the motors 40 are operated to displace the first and second links 22, 26 relative to each other to produce assist forces that assist or bear at least part of the user's weight, thereby assisting the user's walk. The details of the operation of the device D is described in the Patent Reference 1 and the further explanation will not be made.

The walking assist device D according to the embodiments is characterized by length reducing mechanisms 70 each of which reduces length or distance from the third joint 30 (more precisely, the joint shaft 30*a* thereof) to the swing fulcrum (center of curvature 32*a*) as an angle (hereinafter called "knee angle") between the first and second links 22, 26 about the third joint 30 is decreased.

The explanation thereof will be made.

Figure 5:
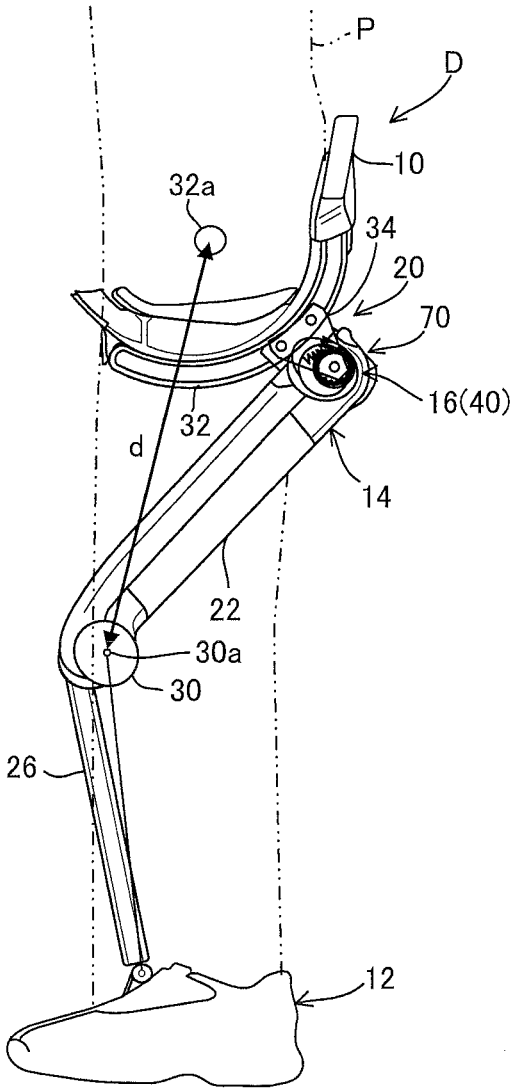
FIG. 5 is a side view of the device (shown using a picture) including a length reducing mechanism shown in FIG. 1, etc.
Figure 6:
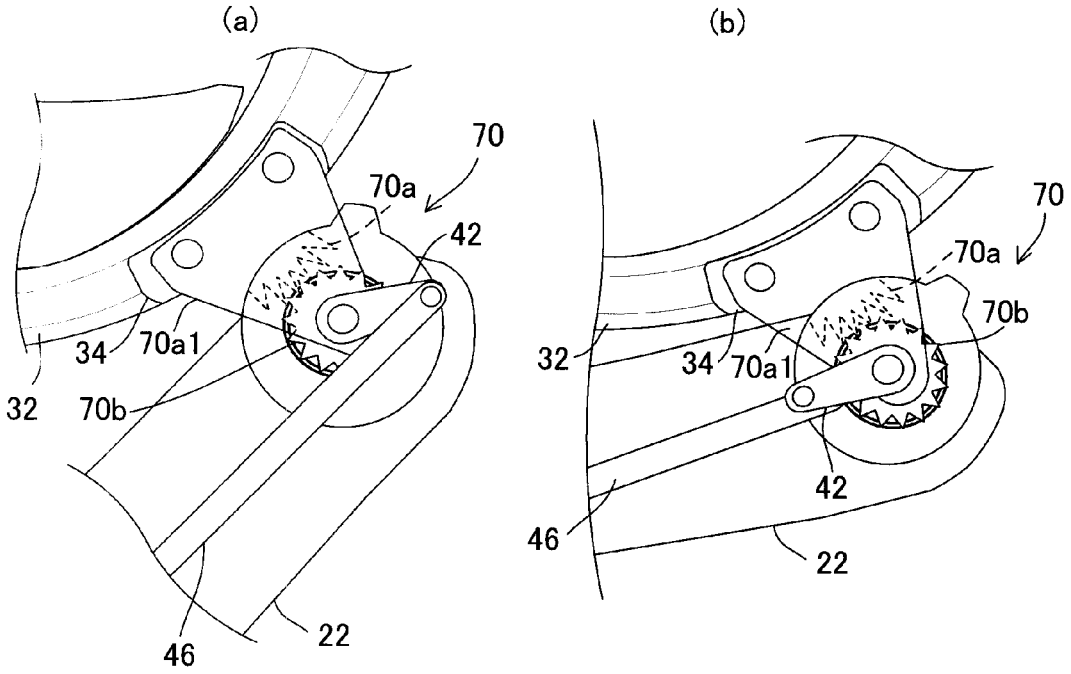
FIG. 6 is a set of enlarged side views showing the operation of the length reducing mechanism of when a third joint shown in FIG. 1, etc., is bent (a knee joint angle is decreased) and of when it is extended (the knee joint angle is increased).
Figure 7:
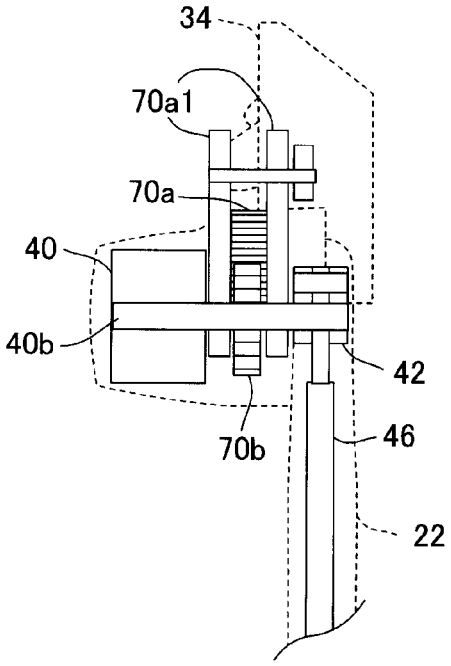
FIG. 7 is a back view of the length reducing mechanism shown in FIG. 6.

FIG. 5 is a side view of the device D (shown using a picture) including the length reducing mechanism 70, FIG. 6 is a set of enlarged side views showing the operation of the mechanism 70 of when the third joint 30 shown in FIG. 1, etc., is bent (the knee joint angle is decreased) and of when it is extended (the knee joint angle is increased), and FIG. 7 is a back view thereof.

As illustrated, each length reducing mechanism 70 comprises a slider gear 70*a* fastened to the slider 34, a link gear 70*b* meshed with the slider gear 70*a* and connected to the actuator 40, and the rocker arm 42. One end of the rocker arm 42 is fastened with the link gear 70*b* and the other end thereof is rotatably connected to the connecting rod 46.

The slider gear 70*a* comprising a sector gear is attached to two triangular plates 70*a*1 fastened to the slider 34 by bolts, i.e., is fastened to the slider 34 through the plates 70*a*1. The link gear 70*b* is fastened (or connected) to the actuator 40, i.e., the output shaft 40*b* thereof, as shown in FIG. 7. The number of teeth of the slider gear 70*a* is larger than that of the link gear 70*b*, for example, defining a ratio of the slider gear 70*a* to the link gear 70 as 2:1.

The operation of the mechanism 70 will be explained with reference to FIGS. 8 to 10.

Figure 8:
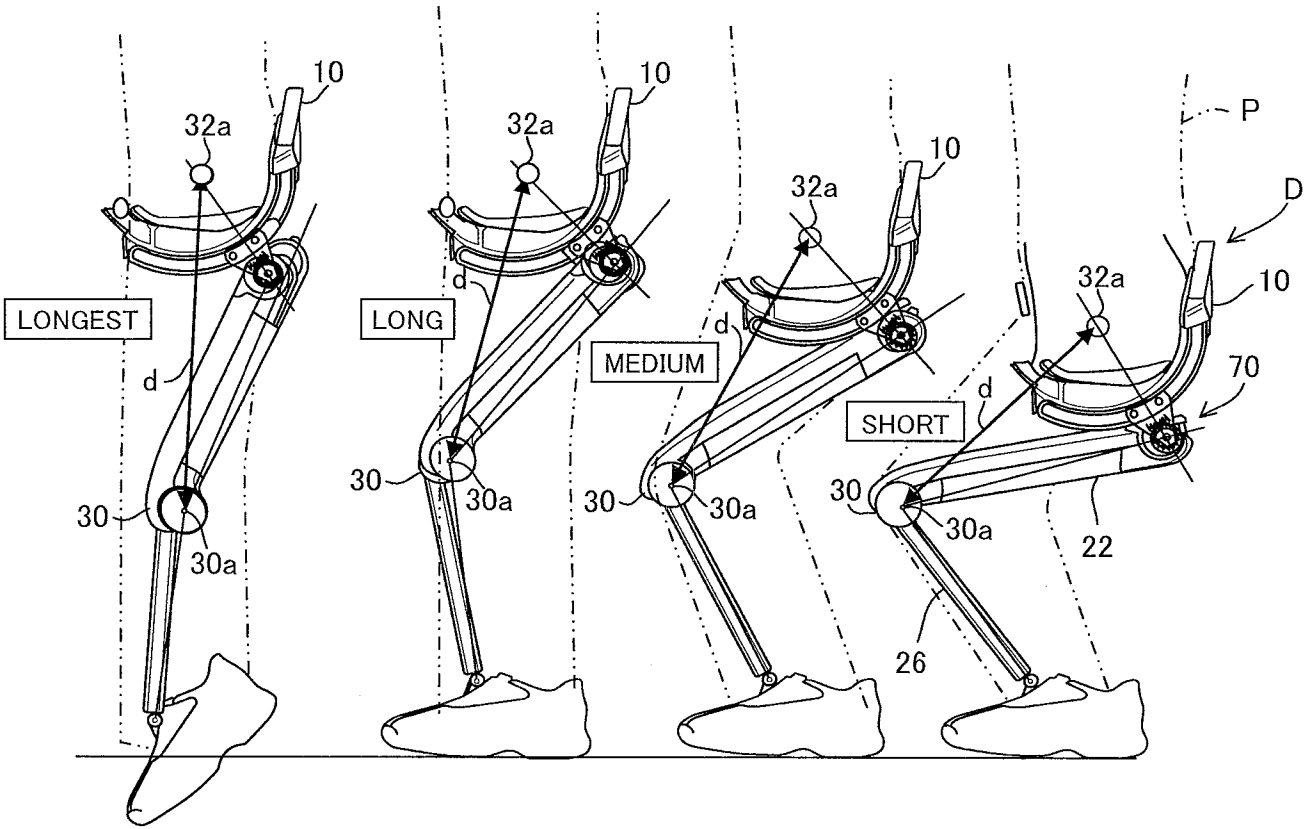
FIG. 8 is a side view of the device (shown using a picture) including the length reducing mechanism shown in FIG. 6.
Figure 9:
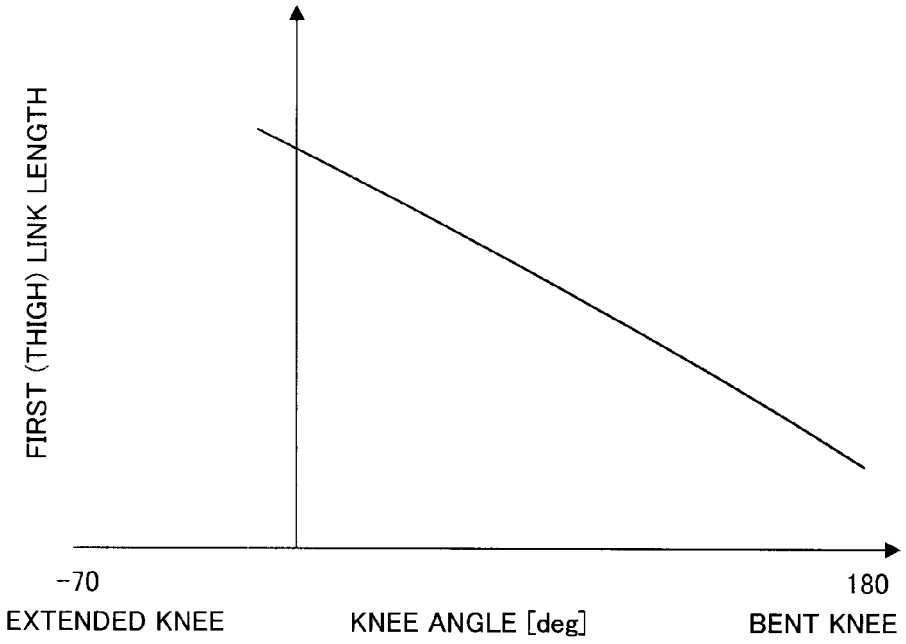
FIG. 9 is a graph showing length of the first link with respect to the knee angle in the device shown in FIG. 1.
Figure 10:
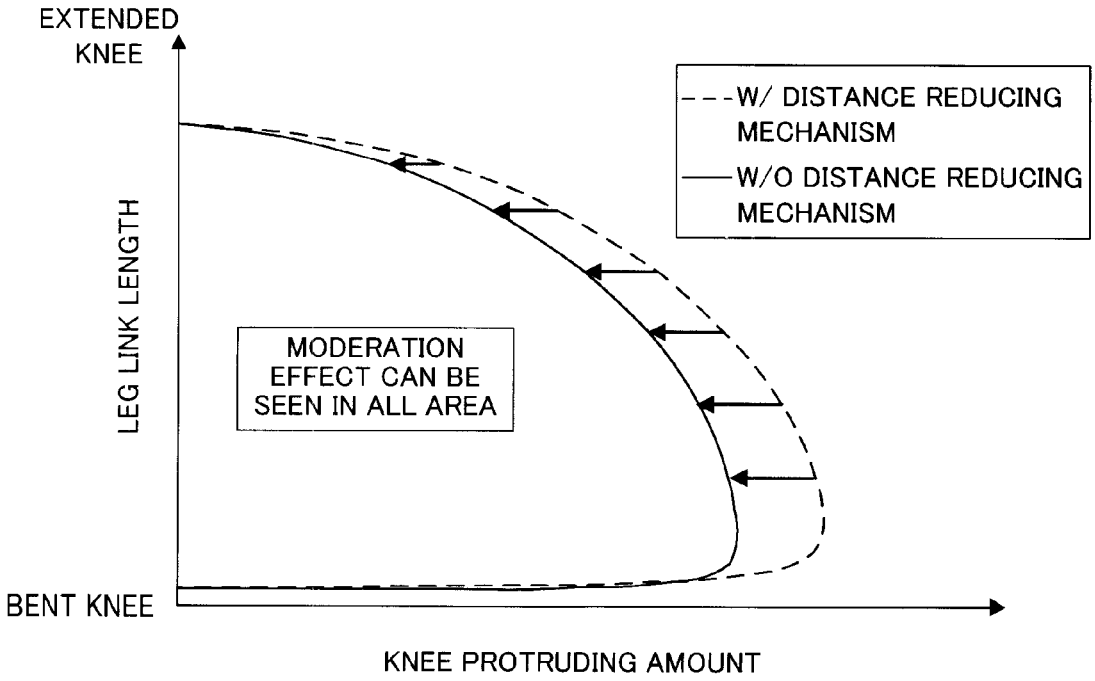
FIG. 10 is a graph showing a forward protruding amount of the third joint with respect to length of a leg link in the device when the length reducing mechanism shown in FIG. 6 is used.

FIG. 8 is a side view of the device D including the mechanism 70, FIG. 9 is a graph showing length of the first (thigh) link 22 with respect to the knee angle, and FIG. 10 is a graph showing a forward protruding amount of the third joint (knee joint) 30 with respect to length of the leg link 14.

As mentioned in the foregoing, the device D is configured so that the third joint 30 is protruded forward from the trunk of the user P to absorb the difference in body height of the user P. As a result, the inertia force about the vertical axis is increased and also the appearance gives the unnatural impression.

To cope with it, in this embodiment, there is provided the length reducing mechanism 70 for reducing the length or distance from the third joint 30 to the swing fulcrum (center of curvature 32*a*) and the link gear 70*b* is driven by the actuator 40 to rotate the rocker arm 42 so as to move the connecting rod 46 backward as shown in FIG. 6.

Consequently, as shown in FIG. 8, as the device knee angle is decreased, i.e., as the third joint 30 is bent, the length or distance d from the third joint 30 (more precisely, the joint shaft 30*a* thereof) to the swing fulcrum (center of curvature 32*a*) is reduced, more exactly, reduced in order from longest, long, medium to short length.

Specifically, the link gear 70*b* is driven by the actuator 40 to rotate the rocker arm 42 to move the connecting rod 46 backward, whereby the first joint 20 is moved backward in the traveling direction of the user, in other words, the length of the first link 22 is virtually reduced with decreasing device knee angle, as shown in FIG. 9.

Owing to this configuration, as shown in FIG. 10, the forward protruding amount of the knee joint (an amount by which the third joint 30 is protruded forward in the traveling direction of the user P) to be increased with decreasing length of the leg link 14, i.e., with decreasing device knee angle, can be suppressed by an amount indicated by arrows compared to the case where no length reducing mechanism 70 is equipped.

As stated above, this embodiment is configured to have a walking assist device D having a support member 10 adapted to support a user P and transmit user's body weight, a pair of leg links 14 each connected to the support member 10 through a first joint 20 constituted of a swing mechanism to be swingable about a swing fulcrum (center of curvature 32*a*) and having a first link 22 and a second link 26 connected to the first link 22 through a second joint (third joint 30), and actuators 40, each of the actuators being operated to displace the first link 22 and the second link 26 relative to each other to produce an assist force that assists at least part of the user P's body weight so as to assist the user P to walk, characterized in that: a forward protruding amount of the second joint (third joint 30) to be protruded with change of an angle between the first link 22 and the second link 26 about the second joint (third joint 30) is changed. With this, where the second joint (third joint 30) is corresponding to the knee joint, it becomes possible to change, i.e., decrease the forward protruding amount of the second joint to be protruded from the trunk of the user with change of the angle about the second joint, thereby decreasing the inertia force about the vertical axis, while mitigating the unnatural impression of the appearance.

More specifically, the device further includes a length reducing mechanism 70 adapted to reduce length from the second joint (third joint 30, more precisely the joint shaft 30*a* thereof) to the swing fulcrum (center of curvature 32*a*) as the angle between the first link 22 and the second link 26 about the second joint (third joint 30) is decreased, such that the forward protruding amount of the second joint to be protruded with change of the angle between the first link 22 and the second link 26 about the second joint is changed. With this, where the second joint (third joint 30) is corresponding to the knee joint, since the forward protruding amount of the second joint (third joint 30) from the trunk of the user is appropriately changed, it becomes possible to decrease the forward protruding amount of the joint 30 from the trunk of the user P accordingly, thereby decreasing the inertia force about the vertical axis, while mitigating the unnatural impression of the appearance.

Further, the first joint 20 includes an arc-shaped guide rail 32 fastened to the support member 10 and having its center of curvature 32*a* at the swing fulcrum and a slider 34 movably engaged with the guide rail 32, the leg link 14 is connected to the support member 10 to be swingable about the center of curvature 32*a* of the guide rail 32, and the actuator 40 is connected to a connecting rod 46 interconnecting the first joint 20 and the second link 26 in the first link 22. With this, in addition to the foregoing effects, it becomes possible to effectively absorb the difference in body height of the user P by adjusting the angle of the third joint 30 corresponding to the knee joint.

Further, the length reducing mechanism 70 includes a slider gear 70*a* fastened to the slider 34, a link gear 70*b* meshed with the slider gear 70*a* and connected to the actuator 40, and a rocker arm 42 fastened at its one end with the link gear 70*b* and rotatably connected at its other end to the connecting rod 46, and the link gear 70*b* is driven by the actuator 40 to rotate the rocker arm 42 to move the connecting rod 46 backward (the length of the first link 22 is virtually reduced) such that the length d from the third joint 30 to the swing fulcrum is reduced. With this, in addition to the foregoing effects, the structure can be made simple.

Further, number of teeth of the slider gear 70*a* is larger than that of the link gear 70*b*. With this, in addition to the foregoing effects, it becomes possible to reduce speed to amplify torque and it can make the actuator 40 compact.

Second Embodiment

Figure 11:
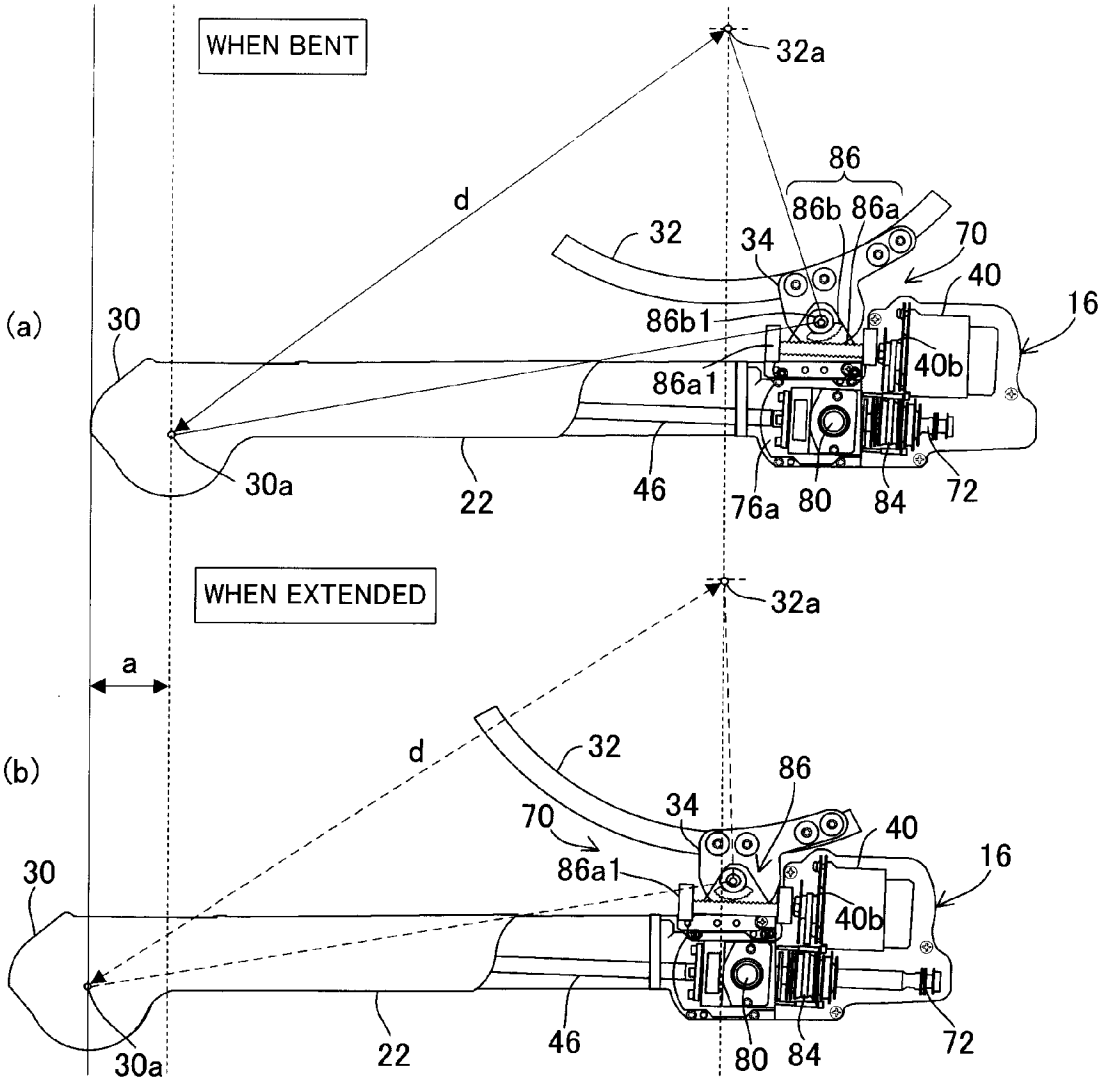
FIG. 11 is a set of enlarged side views showing a length reducing mechanism according to a second embodiment of the invention of when a third joint is bent (a knee joint angle is decreased) and of when it is extended (the knee joint angle is increased).
Figure 12:
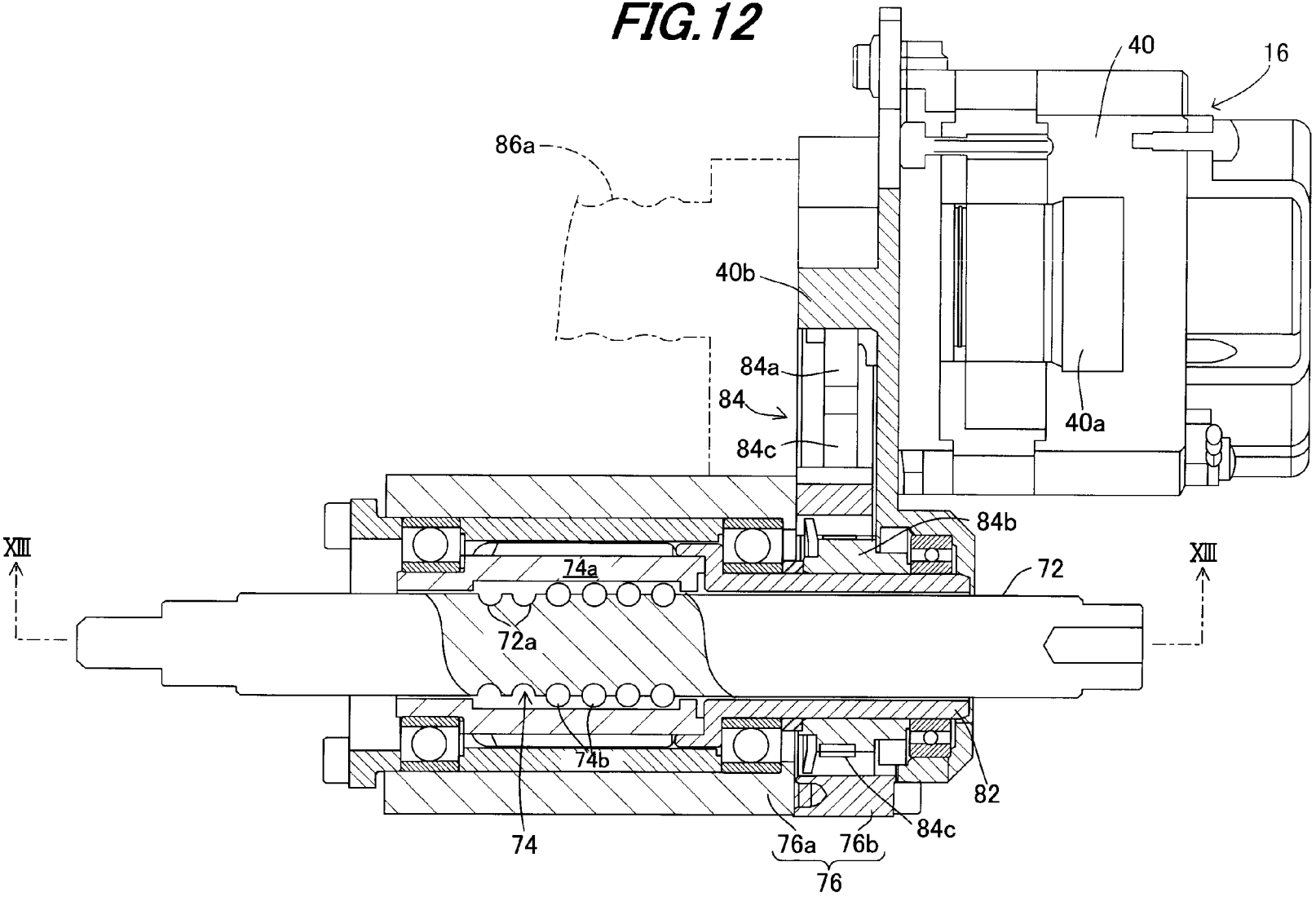
FIG. 12 is a sectional view showing a region around a first joint shown in FIG. 11.
Figure 13:
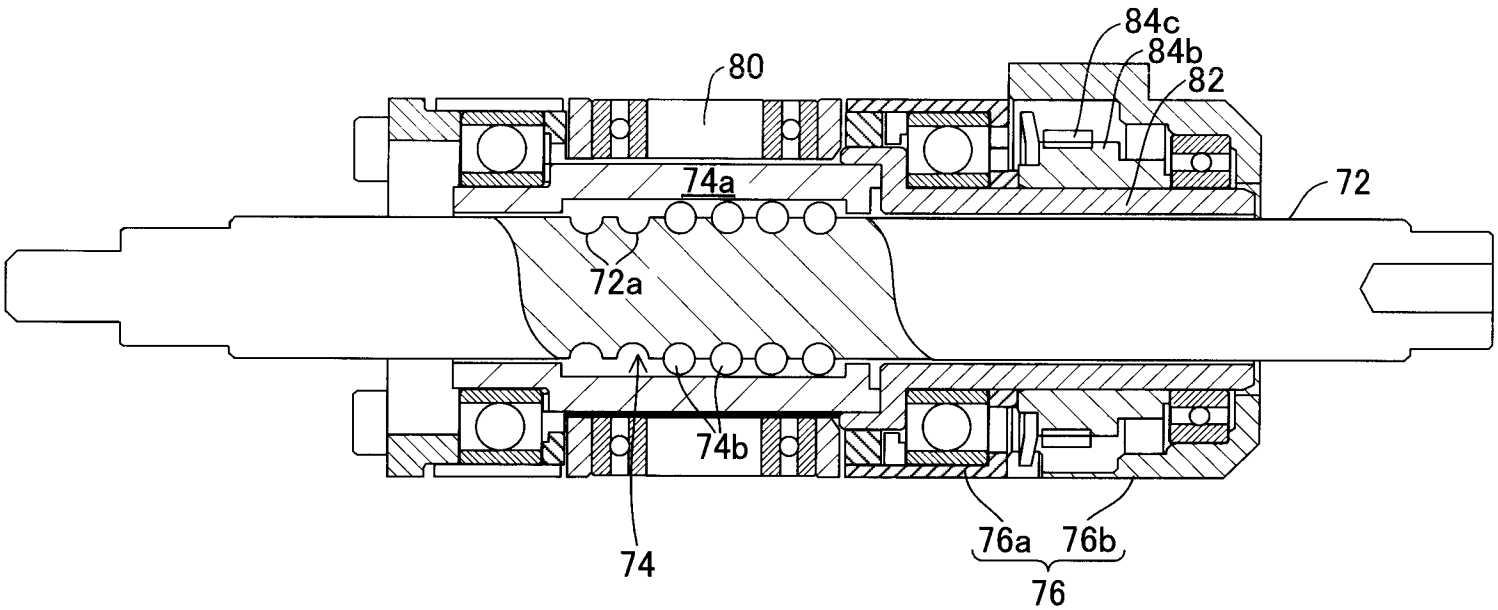
FIG. 13 is a sectional view taken along line XIII-XIII of FIG. 12.

FIG. 11 is a set of enlarged side views showing a length reducing mechanism according to a second embodiment of when the third joint 30 is bent (the knee joint angle is decreased) and of when it is extended (the knee joint angle is increased), FIG. 12 is a sectional view showing a region around the first joint 20 shown in FIG. 11(*a*), and FIG. 13 is a sectional view taken along line XIII-XIII of FIG. 12. In the second and following embodiments, the same constituent elements are assigned by the same reference symbols and will not be explained.

As illustrated, in the second embodiment, the output shaft 40*b* of the actuator 40 of each drive mechanism 16 is installed parallel with the axial direction of the connecting rod 46. The actuator 40 comprises the electric motor the same as in the first embodiment.

The explanation will be made with reference to FIGS. 12 and 13. In the second embodiment, each drive mechanism 16 comprises a case 76 housing a ball screw mechanism 74 that transforms a rotational drive force transmitted from the output shaft 40*b* of the actuator (electric motor) 40 through a belt pulley mechanism (explained later) into a translational force in the axial direction of a linear motion shaft 72. The case 76 comprises a main case 76*a* having a substantially box-like shape and a hollow side case 76*b* fastened to one end of the main case 76*a*. The linear motion shaft 72 is inserted in the interior of the cases 76*a* and 76*b*.

As shown in FIGS. 11(*a*) and (*b*), etc., the first link 22 is penetrated in the lateral direction with a support shaft 80 whose axis is laid parallel with the joint shaft 30*a* of the third joint 30, so that the case 76 is supported by the first link 22 to be swingable about the axis of the support shaft 80. The main case 76*a* houses a main body of the boll screw mechanism 74 in its interior. The linear motion shaft 72 functions as a screw shaft of the ball screw mechanism 74 and is formed on its outer surface with a helical thread groove 72*a*.

The ball screw mechanism 74 is equipped with a cylindrical nut member 74*a* fitted over the linear motion shaft 72 to be coaxial and a plurality of balls 74*b* held on the inner periphery of the nut member 74*a* to be engaged with the groove 72*a*. When the nut member 74*a* is rotated about the linear motion shaft 72, the balls 74*b* are displaced along the groove 72*a* so that the linear motion shaft 72 is moved in the axial direction relative to the nut member 74*a*.

One end of the nut member 74*a* is fastened with a cylindrical member 82 fitted over the linear motion shaft 72 to be coaxial with the nut member 74*a*. The cylindrical member 82 is housed in the case 76, having clearance between the linear motion shaft 72 and itself. The nut member 74*a* and cylindrical member 82 are supported by the case 76 to be rotated about the linear motion shaft 72 integrally with each other.

The output shaft 40*b* of each actuator 40 is fastened with a drive pulley 84*a* of the aforementioned belt pulley mechanism 84 and the cylindrical member 82 is fastened with a driven pulley 84*b*. The pulleys 84*a*, 84*b* are interconnected by a belt 84*c* extending through a notch formed on the side case 76*b*.

Owing to the above configuration, the rotational drive force outputted from the output shaft 40*b* of the actuator 40 is transmitted to the cylindrical member 82 through the belt pulley mechanism 84, so that the cylindrical member 82 and nut member 74*a* are integrally rotated and it displaces the linear motion shaft 72 in the axial direction.

Specifically, the rotational drive force of the actuator 40 is transformed to the translational force in the axial direction of the linear motion shaft 72 through the belt pulley mechanism 84 and ball screw mechanism 74 and the linear motion shaft 72 displaces the connecting rod 46 in the axial direction.

Based on the above premise, the explanation of FIG. 11 is resumed. The length reducing mechanism 70 according to the second embodiment comprises a worm gear mechanism 86 having a worm 86*a* and gear 86*b*. One of the components of the worm gear mechanism 86, i.e., the gear 86*b* is fastened to the slider 34 by a bolt 86*b*1.

The output shaft 40*b* of the actuator 40 is extended on the end side of the drive pulley 84*a* of the belt pulley mechanism 84 and the outer surface of the output shaft 40*b* is formed with the worm 86*a*, i.e., the other of the components of the worm gear mechanism 86, to be meshed with the gear 86*b*. The worm 86*a* is attached to the main case 76*a*, i.e., the base end of the connecting rod 46, through a stay 86*a*1. The remaining configuration is the same as that in the first embodiment.

In the above configuration, when the actuator 40 is operated to rotate the output shaft 40*b* thereof through the speed reducer 40*a*, the worm 86*a* is moved backward and the base end of the connecting rod 46 is moved backward accordingly, as shown in FIG. 11.

Specifically, as shown in FIGS. 11(*a*) and (*b*), when the third joint 30 is bent, the worm 86*a* is moved backward to move the connecting rod 46 backward (to virtually reduce the length of the first link 22). As a result, the length or distance d from the third joint 30 to the swing fulcrum (center of curvature 32*a*) can be reduced by an amount of a and the forward protruding amount of the knee joint (an amount by which the third joint 30 is protruded forward in the traveling direction of the user P) can be decreased accordingly.

As stated above, in the second embodiment, the length reducing mechanism 70 includes one of components of a worm gear mechanism 86 having a worm 86*a* and a gear 86*b* fastened to the slider 34 and other thereof fastened to the connecting rod 46 and also connected to the actuator 40, and the other is driven by the actuator 40 to move the connecting rod 46 backward such that the length d from the third joint 30 to the swing fulcrum is reduced. With this, where the third joint 30 is corresponding to the knee joint, it becomes possible to decrease the forward protruding amount of the joint 30 from the trunk of the user P accordingly, thereby decreasing the inertia force about the vertical axis, while mitigating the unnatural impression of the appearance. Further, the forward protruding amount of the third joint from the trunk of the user can be decreased more smoothly.

Third Embodiment

Figure 14:
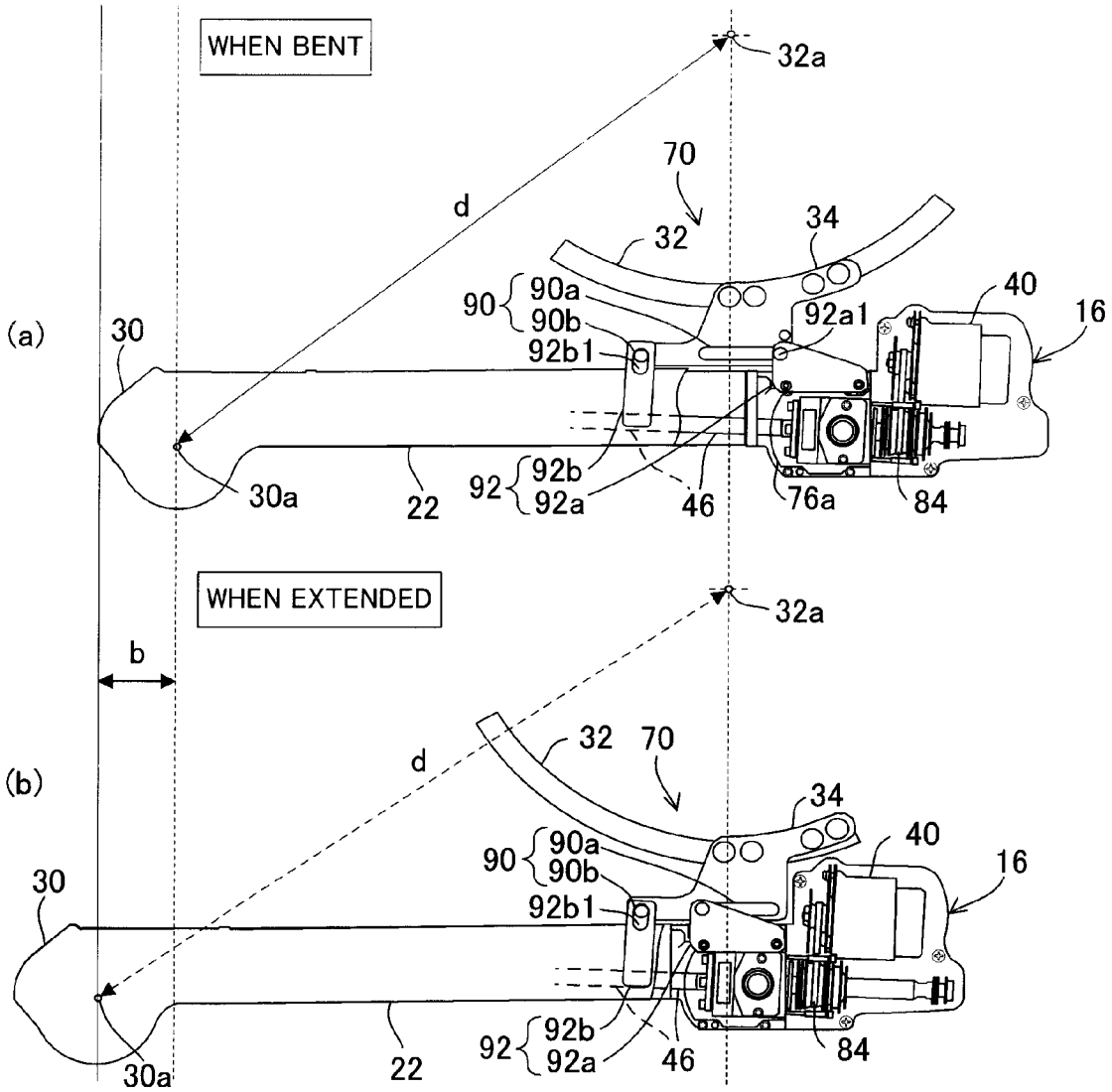
FIG. 14 is a set of enlarged side views showing a length reducing mechanism according to a third embodiment of the invention of when a third joint is bent (a knee joint angle is decreased) and of when it is extended (the knee joint angle is increased).

FIG. 14 is a set of enlarged side views showing the length reducing mechanism 70 according to a third embodiment of the invention of when the third joint 30 is bent (the knee joint angle is decreased) and of when it is extended (the knee joint angle is increased).

The walking assist device D according to the third embodiment is an alternate example of that of the second embodiment, in which instead of the worm gear mechanism, a guide and second slider are provided. Specifically, as shown in FIG. 14(*a*), in the mechanism 70 according to the third embodiment, the slider 34 is formed to have a laterally-expanded, wide end where the guide 90, more exactly, guides 90*a* and 90*b* are formed. The guide 90*a* comprises a slot bored in the end of the slider 34, while a guide 90*b* comprises a pin projecting from the slider 34.

The second slider 92 is movably engaged with the guide 90 and includes a triangular second slider 92*a* and plate-shaped second slider 92*b*.

One component of the second slider 92, i.e., second slider 92*a* has a pin 92*a*1 projecting therefrom and the other component, i.e., the second slider 92*b* has a slot 92*b*1 bored therein. The pin 92*a*1 of the one second slider 92*a* is inserted in the slot 90*a* and the slot 92*b*1 of the other second slider 92*b* is inserted with the pin of the guide 90*b*, so that the second slider 92 is movably engaged with the guides 90*a*, 90*b*.

The one second slider 92*a* is attached to the main case 76*a*, i.e., the base end of the connecting rod 46, while the other second slider 92*b* is fixed to the connecting rod 46 at the middle thereof. The remaining configuration is the same as that in the first embodiment.

In the above configuration, when the actuator 40 is operated and the output shaft 40*b* thereof is rotated, the one second slider 92*a* is moved backward. Specifically, as is clear from a comparison of FIG. 14(*a*) and FIG. 14(*b*), when the third joint 30 is bent, the second slider 92*a* is moved backward to move the connecting rod 46 backward (to virtually reduce the length of the first link 22). As a result, the length or distance d from the third joint 30 to the swing fulcrum (center of curvature 32*a*) can be reduced by an amount of b and the forward protruding amount of the knee joint (an amount by which the third joint 30 is protruded forward in the traveling direction of the user P) can be decreased accordingly.

The other second slider 92*b* is provided for guiding the lateral movement of the one second slider 92*a* relative to the guide 90*a* and hence, is not moved back and forth in response to the operation of the actuator 90.

As stated above, in the third embodiment, the length reducing mechanism 70 includes a guide 90 formed on the slider 34 and a second slider 92*a*, 92*b* movably engaged with the guide 90 and also fastened to the connecting rod 46, and the second slider 92*a*, 92*b* is driven by the actuator 40 to move the connecting rod 46 backward such that the length d from the third joint (more precisely the joint shaft 30*a* thereof) to the swing fulcrum (center of curvature 32*a*) is reduced. With this, where the third joint 30 is corresponding to the knee joint, it becomes possible to decrease the forward protruding amount of the joint 30 from the trunk of the user P accordingly, thereby decreasing the inertia force about the vertical axis, while mitigating the unnatural impression of the appearance. Further, since no gear is used, this configuration can decrease friction.

Fourth Embodiment

Figure 15:
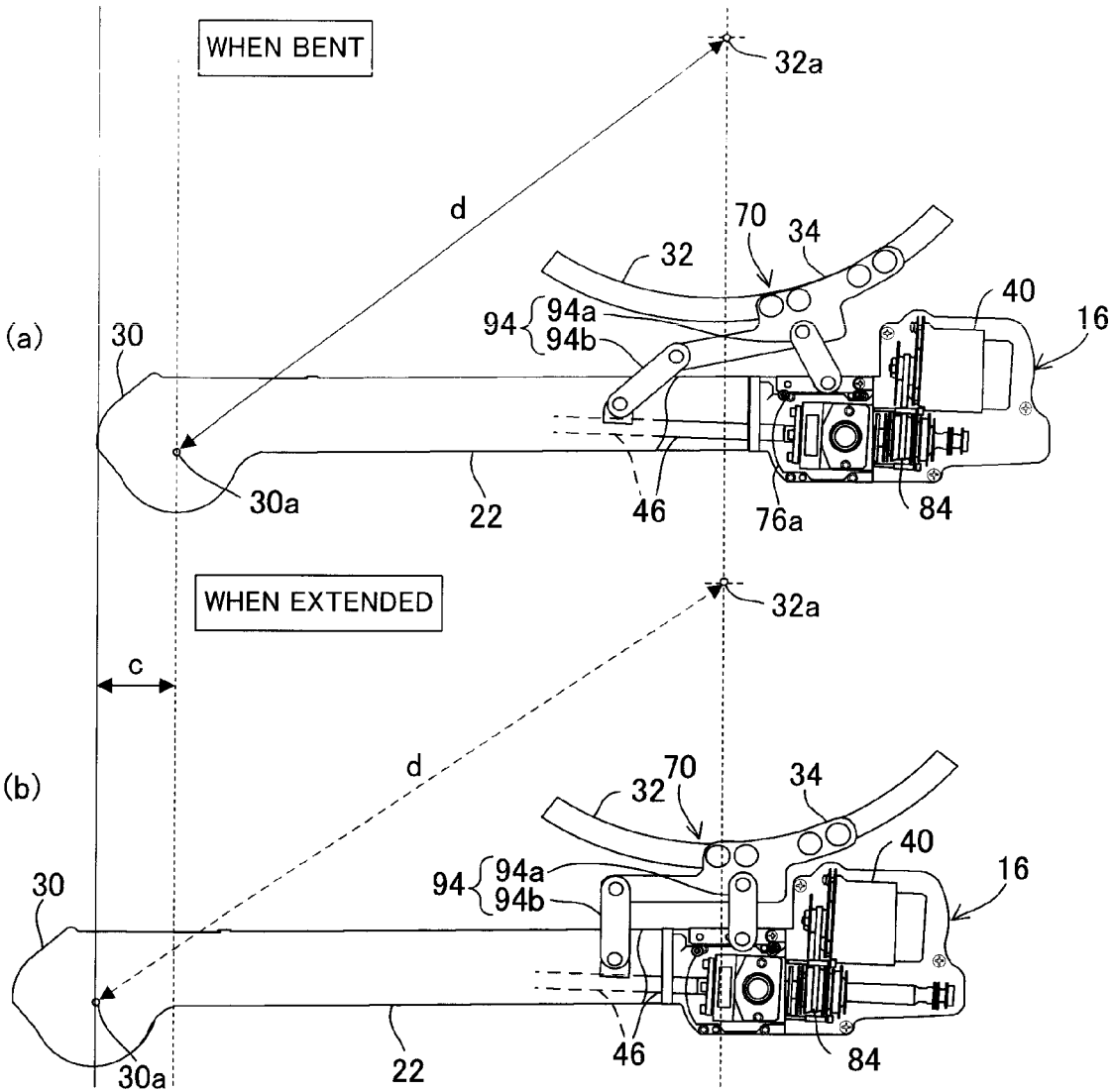
FIG. 15 is a set of enlarged side views showing a length reducing mechanism according to a fourth embodiment of the invention of when a third joint is bent (a knee joint angle is decreased) and of when it is extended (the knee joint angle is increased).

FIG. 15 is a set of enlarged side views showing a length reducing mechanism 70 according to a fourth embodiment of the invention of when the third joint 30 is bent (the knee joint angle is decreased) and of when it is extended (the knee joint angle is increased).

The walking assist device D according to the fourth embodiment is an alternate example of that of the third embodiment, in which instead of the second slider, a link mechanism is provided. Specifically, as shown in FIG. 15(*a*), in the length reducing mechanism 70, the slider 34 is formed to have a laterally-expanded, wide end similarly to the third embodiment and the link mechanism 94, more exactly one ends of the third and fourth links 94*a*, 94*b* are connected to the end of the slider 34.

The other end of the third link 94*a* is attached to the main case 76*a*, i.e., the base end of the connecting rod 46, while the fourth link 94*b* is fixed to the connecting rod 46 at the middle thereof. The remaining configuration is the same as that in the first embodiment.

In the above configuration, the link mechanism 94 movably interconnects the slider 34 and connecting rod 46. Consequently, when the actuator 40 is operated and the output shaft 40*b* thereof is rotated, the connecting rod 46 is moved backward relative to the slider 34 through the link mechanism 94.

Specifically, as shown in FIGS. 15(*a*) and (*b*), when the third joint 30 is bent, the connecting rod 46 is moved backward through the link mechanism 94 (the length of the first link 22 is virtually reduced). As a result, the length or distance d from the third joint 30 to the swing fulcrum can be reduced by an amount of c and the forward protruding amount of the knee joint (an amount by which the third joint 30 is protruded forward in the traveling direction of the user P) can be decreased accordingly.

As stated above, in the fourth embodiment, the length reducing mechanism 70 includes a link mechanism 94 movably connecting the slider 34 with the connecting rod 46, and the link mechanism 94 is driven by the actuator 40 to move the connecting rod 46 backward such that the length d from the third joint 30 (more precisely the joint shaft 30*a* thereof) to the swing fulcrum (center of curvature 32*a*) is reduced. With this, where the third joint 30 is corresponding to the knee joint, it becomes possible to decrease the forward protruding amount of the joint 30 from the trunk of the user P accordingly, thereby decreasing the inertia force about the vertical axis, while mitigating the unnatural impression of the appearance. Further, since no gear is used, this configuration can decrease friction.

Fifth Embodiment

Figure 16:
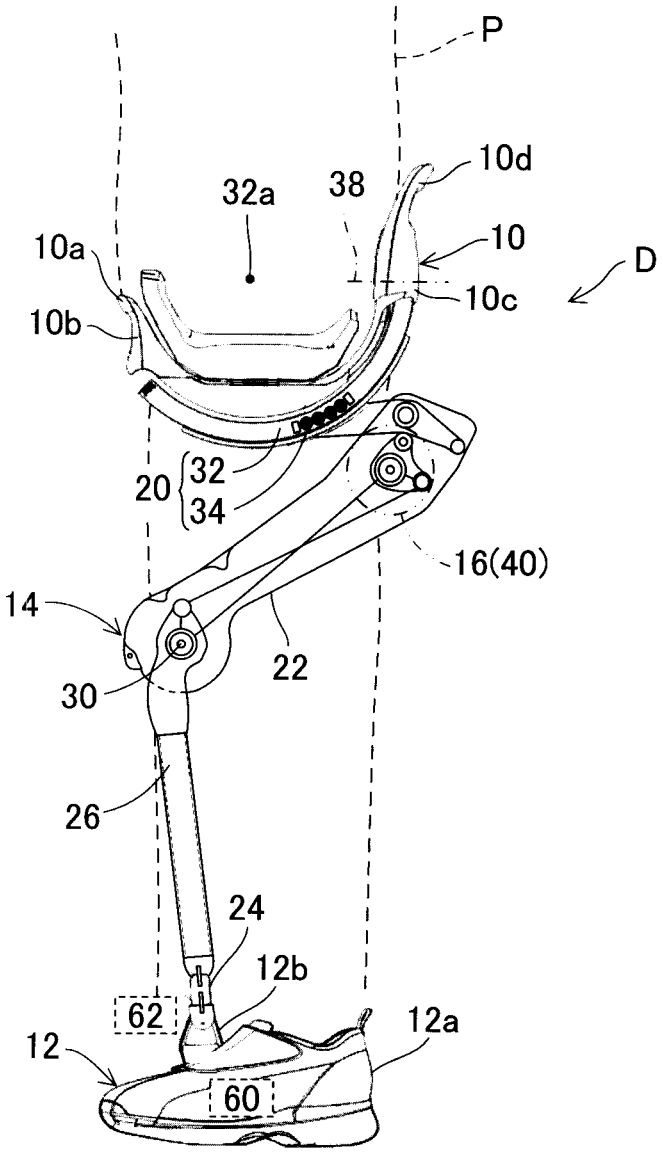
FIG. 16 is a sectional side view partially showing a walking assist device according to a fifth embodiment of the invention.
Figure 17:
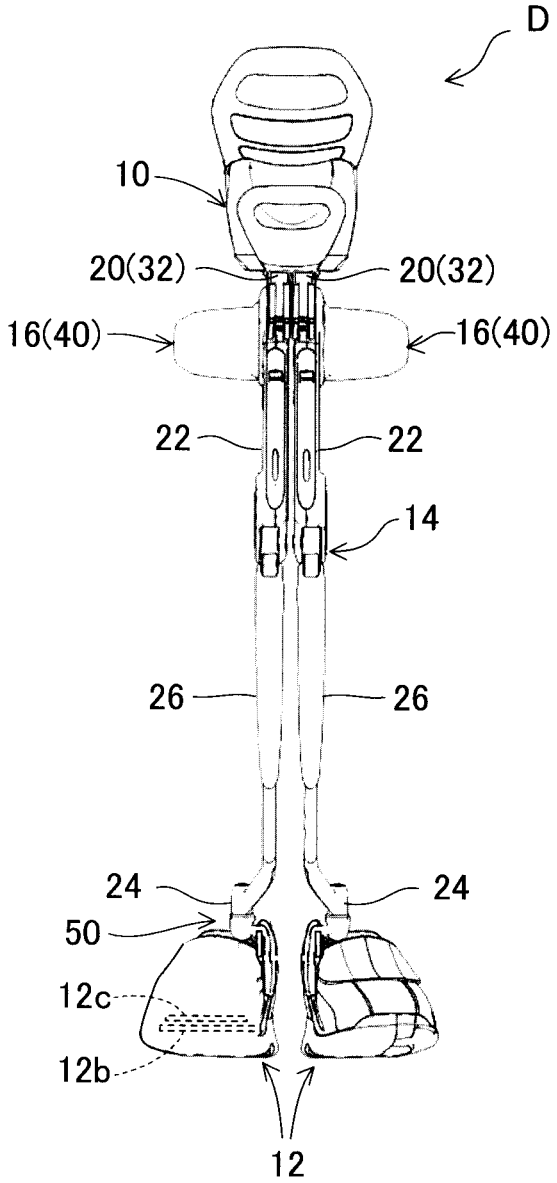
FIG. 17 is a front view of the device shown in FIG. 16.
Figure 18:
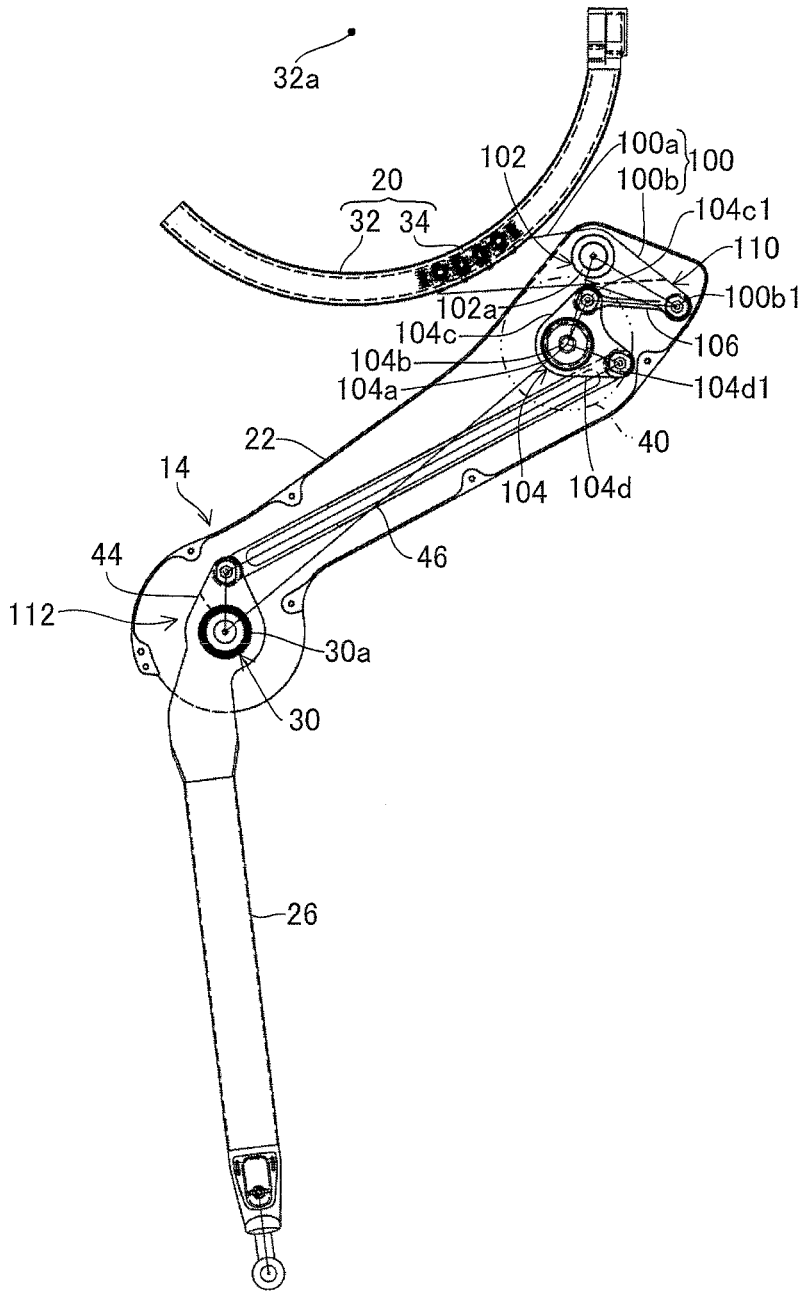
FIG. 18 is an enlarged side view of a leg link shown in FIG. 16, etc.
Figure 19:
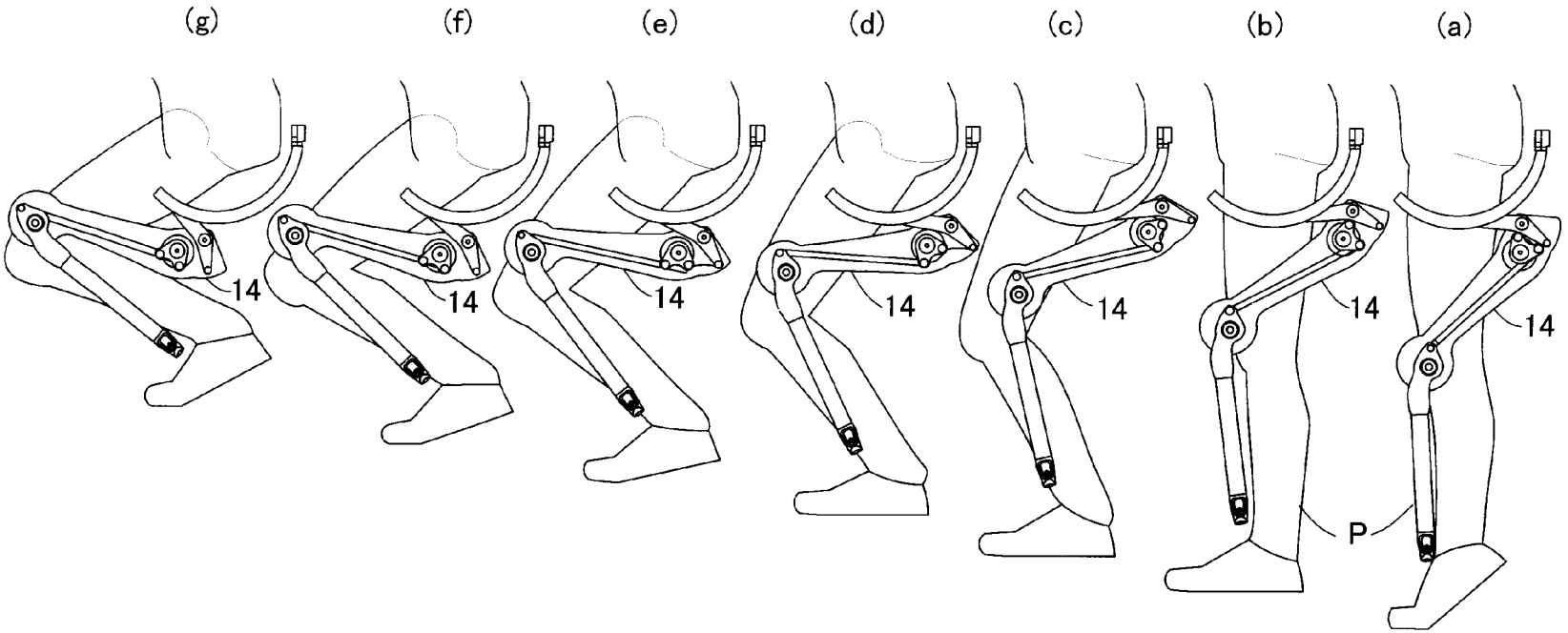
FIG. 19 a set of explanatory views showing the transition of the leg link shown in FIG. 16, etc., changed with the user's posture from a bent knee to an extended knee.
Figure 20:
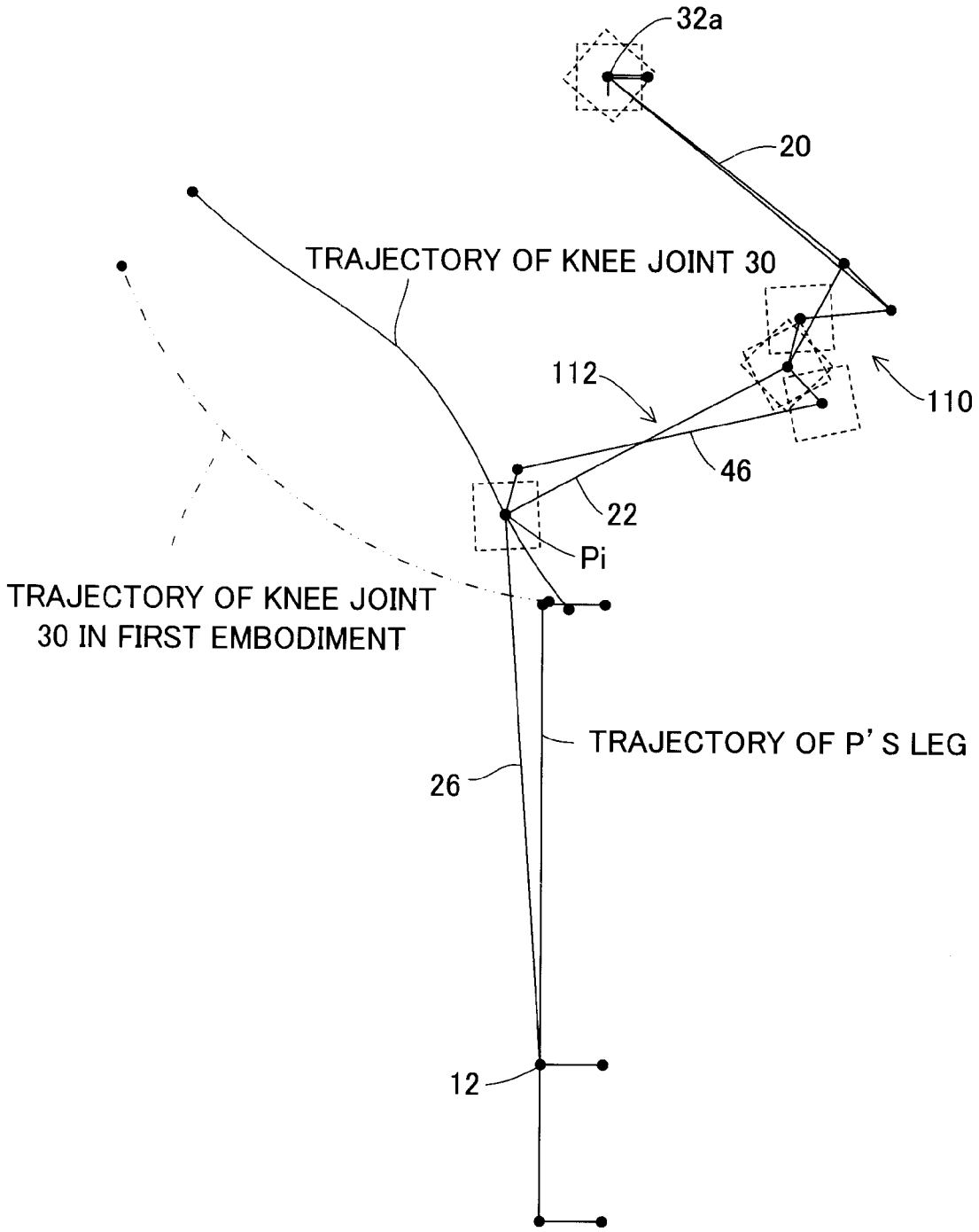
FIG. 20 is an explanatory view similarly showing trajectory of the leg link shown in FIG. 16, etc., changed with the user's posture from the bent knee to the extended knee.
Figure 21:
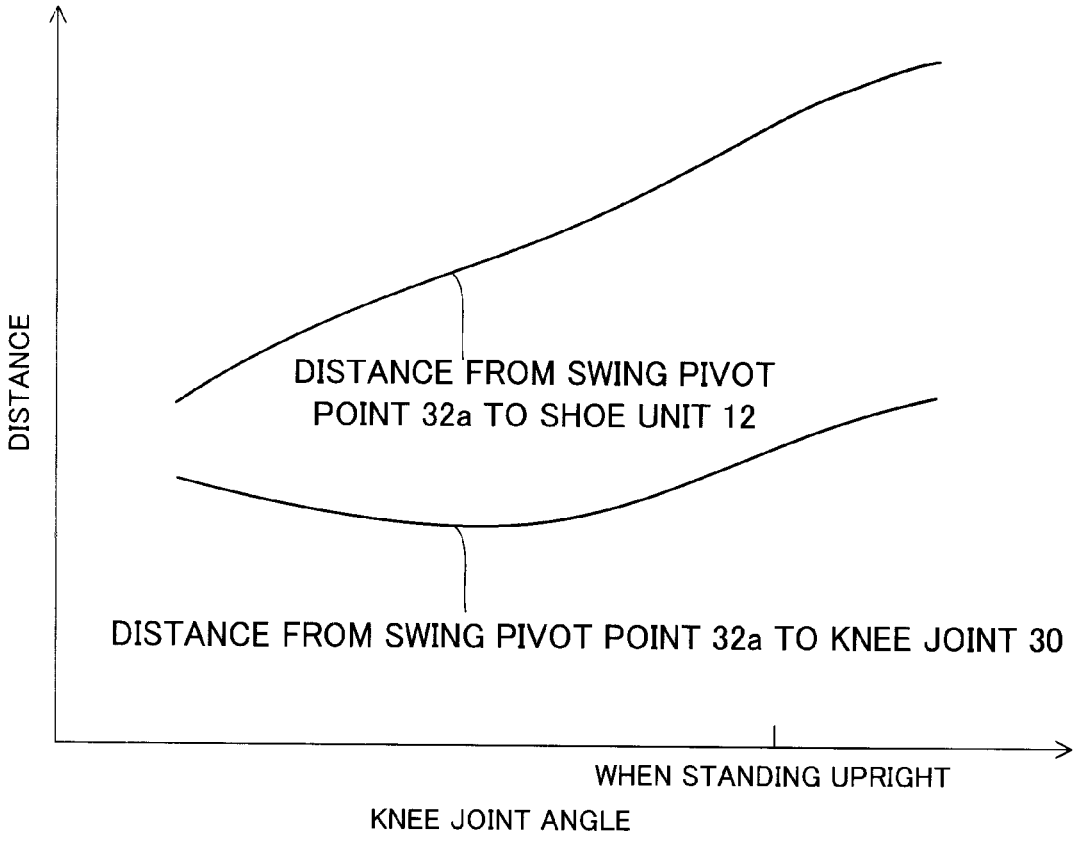
FIG. 21 is a graph similarly showing the characteristics of change in length or distance from a fulcrum to a knee joint with respect to a knee joint angle in the leg link shown in FIG. 16, etc.

FIG. 16 is a sectional side view partially showing a walking assist device according to a fifth embodiment of the invention, FIG. 17 is a front view thereof, FIG. 18 is an enlarged side view of a leg link 14 shown in FIG. 16, etc., FIG. 19 is a set of explanatory views showing the transition of the leg link 14 changed with the user's posture from a bent knee to an extended knee, FIG. 20 is an explanatory view similarly showing trajectory of the leg link 14 changed with the user's posture from the bent knee to the extended knee, and FIG. 21 is a graph similarly showing the characteristics of change in length or distance from the fulcrum to the knee joint with respect to the knee joint angle in the leg link 14.

Note that FIG. 18 is the side view of the leg link 14 when the user P's knee is fully extended or stretched as shown in FIG. 19(*b*). The configuration of the device D shown in FIGS. 16 and 17 is basically the same as that in the first embodiment and the details thereof is omitted but, strictly speaking, the leg link 14 and the like in the fifth and following embodiments is slightly different from the first embodiment.

As shown in FIG. 18, each leg link 14 comprises a third link 100 connected to the first joint 20 having the swing mechanism and the third link 100 and first link 22 are interconnected by a fourth joint (third joint) 102 to be movable relative to each other.

More specifically, the third link 100 is equipped with a link member 100*a* fastened to the slider (movable member) 34 to be engaged with the guide rail 32 that is a constituent element of the swing mechanism of the first joint 20, and with a rocker arm 100*b* fastened to the link member 100*a* through the fourth joint 102.

The fourth joint 102 is provided with a ball bearing 102*a* and the third link 100 is connected to the first link 22 to be rotatable through the ball bearing 102*a*. The first link 22 is installed with a bell crank 104 in the vicinity of the fourth joint 102, etc. The output shaft of the electric motor (actuator) 40 constituting the drive mechanism 16 is positioned near the bell crank 104. The bell crank 104 is supported by the ball bearing 104*a*.

The output of the motor 40 is transmitted to the bell crank 104 to rotate or swing the bell crank 104 about its rotary shaft 104*b*. One end of the rocker arm 100*b* and one crank (fourth link) 104*c* of the bell crank 104 are rotatably interconnected by a connecting rod (fifth link) 106.

Similarly to the first embodiment, the first link 22 is installed with the connecting rod 46 that extends over the substantially entire length of the first link 22 and reaches near the third joint 30. The second link 26 connected to the third joint 30 through the ball bearing 30*a* to be rotatable (movable) relative to the first link 22, is formed with a driven crank arm 44.

The other crank 104*d* of the bell crank 104 having a function of a drive crank arm is connected to the driven crank arm 44 through the connecting rod 46 to transmit the output of the motor 40 to the driven crank arm 44, so that the second link 26 is displaced relative to the first link 22 about the third joint 30 as a fulcrum.

Thus the leg link 14 constituted of the first link 22 and second link 26 comprises a first quadric-link mechanism 110 having the rocker arm 100*b*, the connecting rod 106, the one crank 104*c* of the bell crank 104, and the link connecting the rotary shaft 104*b* of the bell crank 104 with a joint shaft of the fourth joint 102, i.e., the first link 22.

Further, the leg link 14 comprises, in the vicinity of the first quadric-link mechanism 110, a second quadric-link mechanism 112 having the other crank 104*d* of the bell crank 104, the connecting rod 46, the link connecting the third joint 30 with the rotary shaft 104*b* of the bell crank 104 (i.e., first link 22), and the driven crank arm 44 (i.e., second link 26).

As illustrated, the first quadric-link mechanism 110 and second quadric-link mechanism 112 are configured to share the rotary shaft 104*b* of the bell crank 104, i.e., at least one of kinematic pair points constituting the mechanisms 110, 112.

Next, the operation of the leg link 14 is explained with reference to FIGS. 18 to 21. In FIG. 20, the trajectory of the third joint 30 is indicated in contrast with the trajectory of the third joint 30 in the first embodiment.

In FIG. 18, upon the rotation of the motor 40, the bell crank 104 of the first quadric-link mechanism 110 is rotated counterclockwise about the rotary shaft 104*b* and it results in the position shown in FIG. 19(*a*) in which the user P assumes a posture with his/her heel being lifted up.

When the motor 40 is rotated reversely under this condition, the bell crank 104 is rotated clockwise about the rotary shaft 104*b* in FIG. 18. When the rotation is continued and the rotation of the bell crank 104 reaches a certain angle or thereabout as shown in FIG. 19(*g*), three rotary shafts (kinematic pair points) are aligned to establish a dead point.

Specifically, the first quadric-link mechanism 110 is configured so that a rotary shaft 100*b*1 of the rocker arm 100*b*, a rotary shaft 104*c*1 of the one crank 104*c* of the bell crank, and a rotary shaft 104*d*1 of the other crank 104*d* of the bell crank 104 are positioned in a straight line, in other words, so that at least the three kinematic pair points are positioned in a straight line, i.e., configured to have the dead point.

Then, when the motor 40 is further rotated in the same direction, the three rotary shafts 100*b*1, 104*c*1, 104*d*1 are moved to pass the dead point and further moved to allow the user P's knee to bend to the maximum extent, as shown in FIG. 19(*g*).

Further, since the first quadric-link mechanism 110 and second quadric-link mechanism 112 are configured to share the rotary shaft (kinematic pair point) 104*b* of the bell crank 104, the movement of the first quadric-link mechanism 110 is transmitted to the second quadric-link mechanism 112 through the rotary shaft 104*b*.

Thus, in the fifth embodiment, the drive force of the motor 40 is distributed to the first and second links 22, 26 to drive them, and the second link 26 is connected with the second quadric-link mechanism 112 (that shares the rotary shaft with the first quadric-link mechanism 110) so that the drive force of the motor 40 is distributed (transmitted) to the second link 26 through the second quadric-link mechanism 112.

More specifically, the movement of the crank 104*d* functioning as the drive crank arm of the bell crank 104 is transmitted to the driven crank arm 44 through the connecting rod 46, so that the second link 26 is moved relative to the first link 22 about the axis line of the third joint (knee joint) 30.

Further, in the fifth embodiment, when the second link 26 is moved relative to the first link 22 about the axis line of the third joint (knee joint) 30, as shown in FIG. 20, the third joint 30 describes the trajectory having at least one inflection point Pi when viewed from the side.

Furthermore, as the angle between the first and second links 22, 26 about the third joint 30, i.e., the knee joint angle is decreased, as shown in FIG. 21, the length or distance from the third joint 30 to the swing fulcrum 32*a* is changed in line with trajectory having the nonlinear characteristics when viewed from the side.

As stated above, in the fifth embodiment, the leg link 14 includes a third link 100 connected to the first joint 20, and the third link 100 and the first link 22 are interconnected by a fourth joint (third joint) 102 to be movable relative to each other, such that the forward protruding amount of the second joint to be protruded with change of the angle between the first link 22 and the second link 26 about the second joint (third joint) 30 is changed. With this, where the third joint (second joint) 30 is corresponding to the knee joint, when a positional relationship among the third link 100 and other components is appropriately set, the length or distance from the swing fulcrum 32*a* to the knee joint can be changed and hence, it becomes possible to decrease the forward protruding amount of the knee joint (third joint 30) from the trunk of the user P, thereby decreasing the inertia force about the vertical axis, avoiding the interference with surrounding members and also mitigating the unnatural impression of the appearance.

Specifically, since the third link 100 and first link 22 are interconnected by the fourth joint (third joint) 102 to be movable relative to each other, when the fourth joint 102 is driven, the length or distance from the swing fulcrum 32*a* to the end of the leg link 14 (shoe unit 12) can be increased with increasing angle (knee joint angle) of the third joint (second joint) 30. As a result, it becomes possible to ensure the large angle (knee joint angle) of the third joint 30 at the time when the user P stands upright and hence, the forward protruding amount of the device knee joint from the trunk of the user P can be decreased.

Further, movement of the third joint (second joint) 30 describes trajectory having at least one inflection point Pi as viewed from side when the motor 40 is operated to displace the first link 22 and second link 26 relative to each other. With this, in addition to the foregoing effects, since the trajectory is appropriately set, the length or distance from the swing fulcrum 32*a* to the end of the leg link 14 can be increased with increasing angle of the third joint (second joint) 30. As a result, it becomes possible to ensure the further large angle of the third joint 30 at the time when the user P stands upright.

Further length from the third joint 30 to the swing fulcrum 32*a* is changed in line with trajectory having nonlinear characteristics as viewed from side as the angle between the first link 22 and the second link 26 about the third joint (second joint) 30 is decreased when the motor 40 is operated to displace the first link 22 and second link 26 relative to each other. With this, in addition to the foregoing effects, since the trajectory is appropriately set, similarly the length or distance from the swing fulcrum 32*a* to the end of the leg link 14 can be increased with increasing angle of the third joint 30. As a result, it becomes possible to ensure the further large angle of the third joint 30 at the time when the user P stands upright.

Further, the device further includes one crank 104*c* of the bell crank 104 (fourth link) connected to the first link 22 and a connecting rod (fifth link) 106 connected at its one end to the one crank 104*c* and at other end to the third link 100, i.e., the rocker arm 100*b* thereof, and a first quadric-link mechanism 110 constituted of the first link 22, third link 100, crank 104*c* and connecting rod 106 is driven by the motor (actuator) 40. With this, in addition to the foregoing effects, since the length of the links constituting the first quadric-link mechanism 110 are appropriately set, it enables the input/output characteristics of the first quadric-link mechanism 110 to exhibit the curve characteristics, thereby achieving the smooth movement of the leg link 14.

Further, the first quadric-link mechanism 110 establishes a dead point at which at least three of kinematic pair points are positioned in a straight line. With this, in addition to the foregoing effects, it becomes possible to more effectively decrease the forward protruding amount of the device knee joint of when (before/after) the user P's knee is fully extended.

Further, a drive force of the motor (actuator) 40 is distributed to the first link 22 and the second link 26 to drive them. With this, in addition to the foregoing effects, the installment of only one motor 40 suffices, thereby achieving the simple and light structure.

Further, the second link 26 is connected to a second quadric-link mechanism 112 and the drive force of the motor 40 is distributed to the second link 26 through the second quadric-link mechanism 112. With this, in addition to the foregoing effects, since the length of the links constituting the second quadric-link mechanism 112 are appropriately set, it enables the input/output characteristics of the second quadric-link mechanism 112 to exhibit the curve characteristics, thereby achieving the further smooth movement of the leg link 14.

Further, the second quadric-link mechanism 112 shares at least one of kinematic pair points with the first quadric-link mechanism 110. With this, in addition to the foregoing effects, it becomes possible to make the structure simple due to the shared kinematic pair point.

Sixth Embodiment

Figure 22:
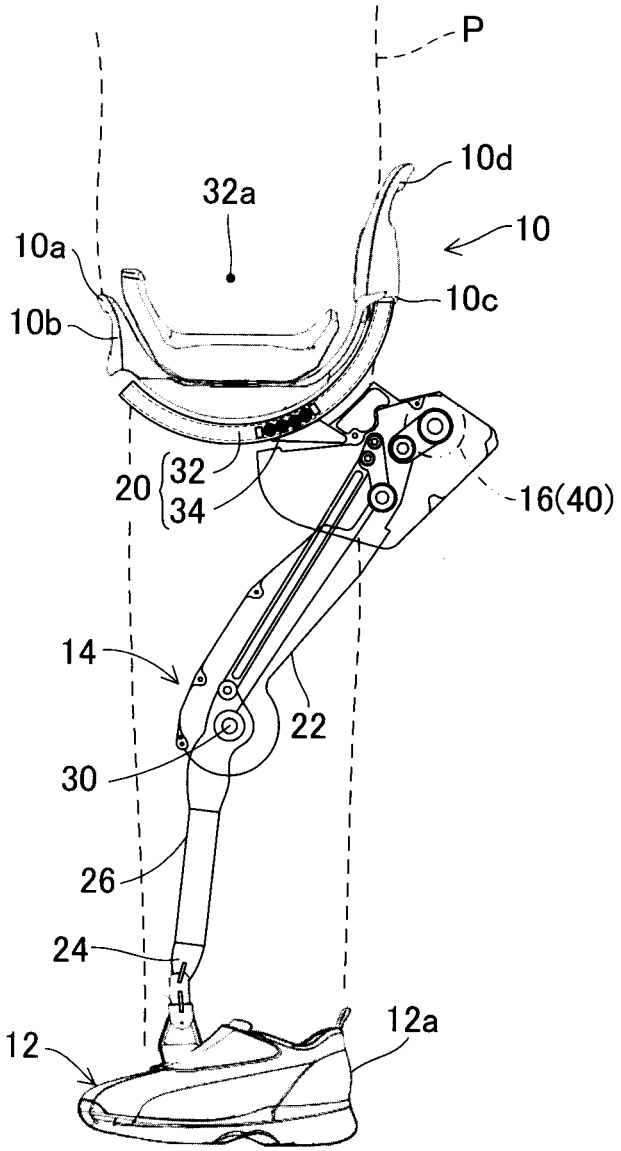
FIG. 22 is a sectional side view partially showing a walking assist device according to a sixth embodiment of the invention.
Figure 23:
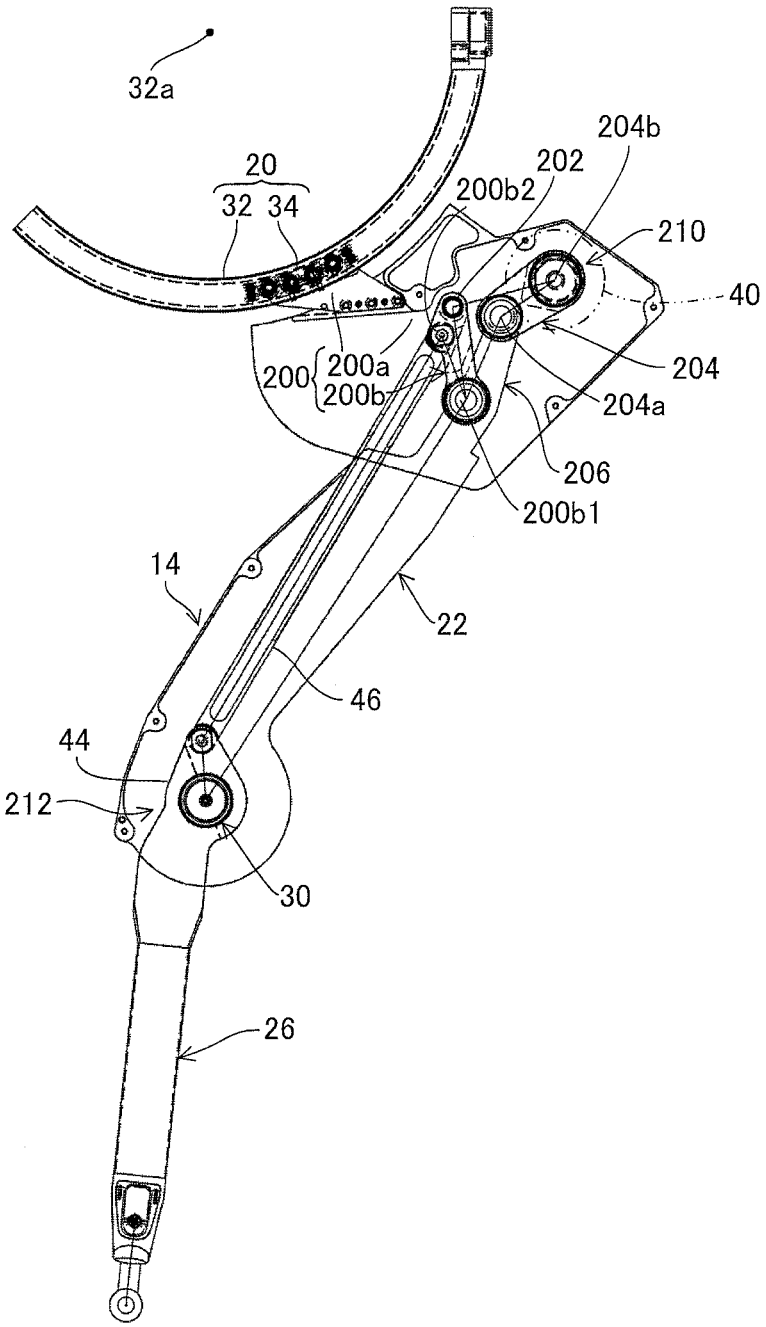
FIG. 23 is an enlarged side view of a leg link shown in FIG. 22.
Figure 24:
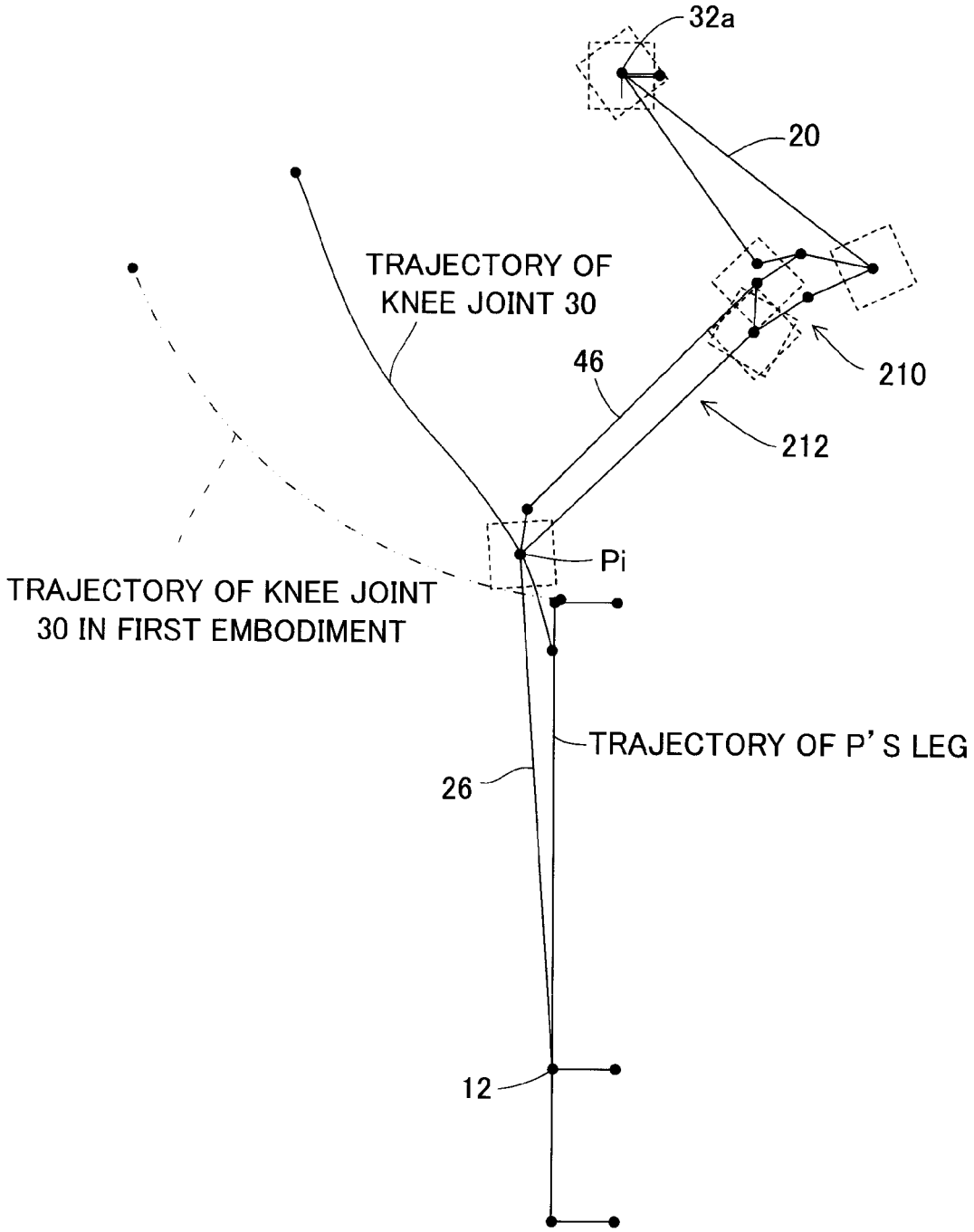
FIG. 24 is an explanatory view showing the transition of the leg link shown in FIG. 23 changed with the user's posture from a bent knee to an extended knee.
Figure 25:
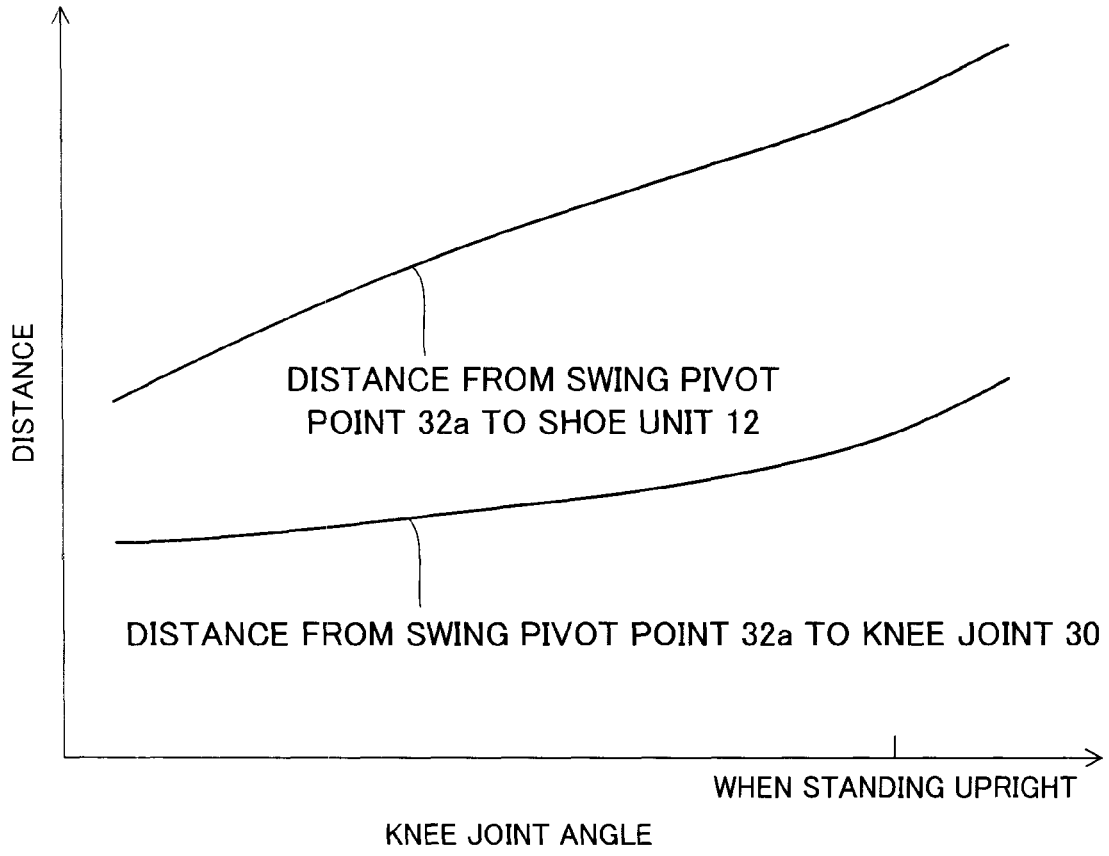
FIG. 25 is a graph similarly showing the characteristics of change in length or distance from a fulcrum to a knee joint with respect to a knee joint angle in the leg link shown in FIG. 23.

FIG. 22 is a sectional side view partially showing a walking assist device D according to a sixth embodiment of the invention, FIG. 23 is an enlarged side view of a leg link 14 shown in FIG. 22, FIG. 24 is an explanatory view similar to FIG. 20, but showing the transition of the leg link 14 shown in FIG. 23 changed with the user's posture from a bent knee to an extended knee, and FIG. 25 is a graph showing the characteristics of change in length or distance from the swing fulcrum 32*a* to the knee joint with respect to the knee joint angle in the leg link 14.

The explanation will be made with focus on points of difference from the fifth embodiment. In the sixth embodiment, as shown in FIG. 23, each leg link 14 is equipped with a third link 200 connected to the first joint 20 comprising a swing mechanism, and the third link 200 and first link 22 are interconnected by a fourth joint 202 to be movable relative to each other.

Specifically, the third link 200 has a portion fixed to the slider 34 in engagement with the guide rail 32 constituting the swing mechanism of the first joint 20, while including a link member 200*a* of a wide plate shape spreading over an upper end of the first link 22, and a rocker arm 200*b* connected to the link member 200*a* through the fourth joint 202. The first link 22 is formed tapered in a region overlapping the third link 200, and one end of the rocker arm 200*b* is connected to the first link 22.

More specifically, the one end of the rocker arm 200*b* is rotatably connected to the link member 200*a* through the fourth joint 202 and a rotary shaft 200*b*1 of the other end thereof is disposed with a ball bearing so that the rocker arm 200*b* is rotatably connected to the first link 22 at a position on the base end side of the tapered portion through the ball bearing.

A crank 204 is rotatably connected to the first link 22 at a position on the tip side of the tapered portion. In other words, the tapered portion of the first link 22 functions as a connecting rod 206. The crank 204 installed on the tip side of the first link 22 is connected to the connecting rod 206 through a rotary shaft 204*a* having a ball bearing.

The other end of the crank 204 is connected to the output shaft of the motor 40 through a rotary shaft 204*b* having a ball bearing, so that the output of the motor 40 is transmitted to the crank 204 to swing the crank 204 about the rotary shaft 204*b*.

The movement of the crank 204 is transferred through the connecting rod 206 to the rocker arm 200*b* to swing it. Specifically, the crank 204 and rocker arm 200*b* constitute a parallel link and hence, are swung in parallel in response to the output of the motor 40, thereby moving the first link 22 in the swing direction.

The rocker arm 200*b* is disposed in the vicinity of the fourth joint 202 with a rotary shaft 200*b*2 where one end of the connecting rod 46 is rotatably connected. The connecting rod 46 extends over the substantially entire length of the first link 22 and is connected to the driven crank arm 44 of the third joint 30.

As a result, the output of the motor 40 is transmitted to the driven crank arm 44 through the crank 204, rocker arm 200*b* and connecting rod 46, so that the second link 26 is displaced relative to the first link 22 about the third joint 30 as a fulcrum.

Thus, in the sixth embodiment, the leg link 14 having the first and second links 22, 26 comprises a first quadric-link mechanism 210 constituted of the rocker arm 200*b*, connecting rod 206, crank 204 and link connecting the rotary shaft 240*b* of the crank 204 with the fourth joint 202, i.e., first link 22.

Further, the leg link 14 comprises, in the vicinity of the first quadric-link mechanism 210, a second quadric-link mechanism 212 constituted of the rocker arm 200*b*, more precisely the rocker arm 200*b* including an axis line interconnecting rotary shafts 200*b*1 and 200*b*2, the connecting rod 46, the link connecting the third joint 30 with the rotary shaft 200*b*1 of the rocker arm 200*b* (and connecting rod 206) (i.e., the first link 22), and the driven crank arm 44 (i.e., the second link 26).

As illustrated, the first quadric-link mechanism 210 and second quadric-link mechanism 212 are configured to share the rotary shaft 200*b*1 of the rocker arm 200*b* (and connecting rod 206), i.e., at least one of kinematic pair points constituting the quadric-link mechanisms 210 and 212.

Next, the operation of the aforementioned leg link 14 is explained with reference to FIGS. 23 to 25 and FIG. 19 of the fifth embodiment.

Since the position of the crank 204 in FIG. 23 corresponds to the condition where the user P's knee is fully extended or stretched to the limit of the leg link 14 as in FIG. 19(*b*), when the motor 40 is rotated reversely under this condition, the crank 204 is rotated counterclockwise about the rotary shaft 204*b* in FIG. 23.

When the rotation of the crank 204 reaches a certain angle or thereabout as shown in FIG. 19(*g*), due to the configuration of the first quadric-link mechanism 210, three rotary shafts (kinematic pair points), i.e., the rotary shaft 200*b*1 of the rocker arm 200*b*, the rotary shaft 204*a* of the crank 204 and the other rotary shaft 204*b* of the crank 204 are aligned, in other words, at least the three kinematic pair points are positioned in a straight line to establish a dead point.

Then, when the motor 40 is further rotated in the same direction, the three rotary shafts 200*b*1, 204*a*, 204*b* are moved to pass the dead point and further moved to allow the user P's knee to bend to the maximum extent, as shown in FIG. 19(*g*).

Further, since the first quadric-link mechanism 210 and second quadric-link mechanism 212 are configured to share the rotary shaft (kinematic pair point) 200*b*1 of the rocker arm 200*b* (and connecting rod 206), the movement of the first quadric-link mechanism 210 is transmitted to the second quadric-link mechanism 212 through the rotary shaft 200*b*1.

Thus, in the sixth embodiment, the drive force of the motor 40 is distributed to the first and second links 22, 26 to drive them, and the second link 26 is connected with the second quadric-link mechanism 212 (that shares the rotary shaft with the first quadric-link mechanism 210) so that the drive force of the motor 40 is distributed (transmitted) to the second link 26 through the first and second quadric-link mechanisms 210, 212.

Further, in the sixth embodiment, when the second link 26 is moved relative to the first link 22 about the axis line of the third joint (knee joint) 30, as shown in FIG. 24, the third joint 30 describes the trajectory having at least one inflection point Pi when viewed from the side. Also, as the knee joint angle is decreased, as shown in FIG. 25, the length or distance from the third joint 30 to the swing fulcrum 32*a* is changed in line with trajectory having the nonlinear characteristics when viewed from the side, more exactly, the length or distance from the third joint 30 to the swing fulcrum 32*a* is reduced.

In the sixth embodiment, the first and second quadric-link mechanisms 210, 212 have the same structures as in the fifth embodiment.

As stated above, in the sixth embodiment, the leg link 14 includes a third link 200 having the swing mechanism and connected to the first joint 20, and the third link 200 and the first link 22 are interconnected by a fourth joint (third joint) 202 to be movable relative to each other, such that the forward protruding amount of the second joint to be protruded with change of the angle between the first link 22 and the second link 26 about the second joint (third joint 30) is changed. With this, where the third joint (second joint) 30 is corresponding to the knee joint, it becomes possible to change the length or distance from the swing fulcrum 32*a* to the knee joint. Therefore, the forward protruding amount of the device knee joint from the trunk of the user P can be decreased, thereby decreasing the inertia force about the vertical axis, avoiding the interference with surrounding members and also mitigating the unnatural impression of the appearance. The remaining configuration is the same as that in the fifth embodiment.

Seventh Embodiment

Figure 26:
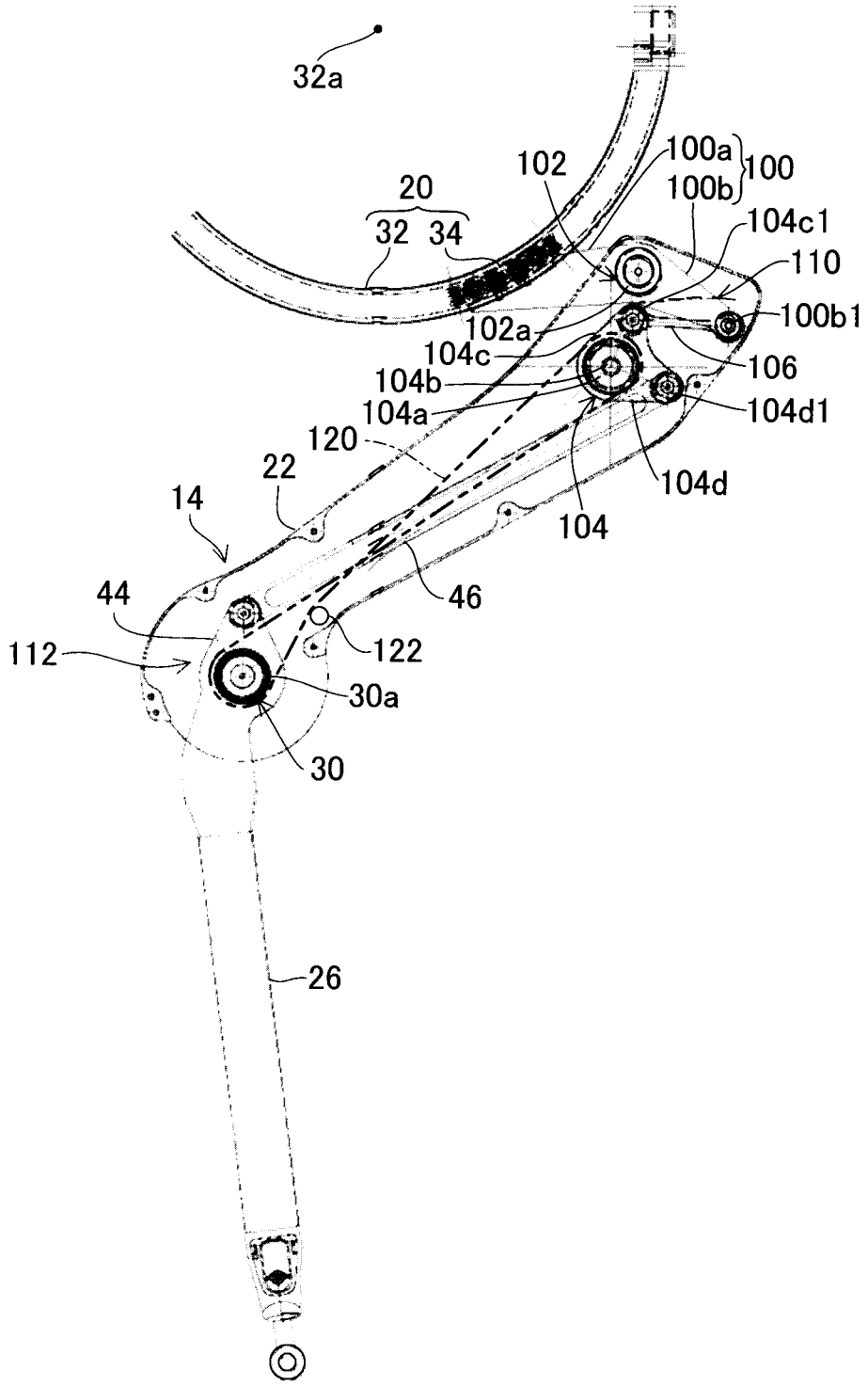
FIG. 26 is an enlarged side view of a leg link of a walking assist device according to a seventh embodiment of the invention.

FIG. 26 is an enlarged side view of a walking assist device D according to a seventh embodiment of the invention, specifically of a leg link 14 similar to that of FIG. 18 in the fifth embodiment.

The explanation will be made with focus on points of difference from the foregoing embodiments. In the seventh embodiment, as indicated by an imaginary line in the drawing, instead of the second quadric-link mechanism 112 (or 212), a chain mechanism 120 is provided. The chain mechanism 120 is wound around the bell crank 104 and third joint 30 through an idler 122.

Specifically, in the seventh embodiment, the drive force of the motor 40 is distributed to the first and second links 22, 26 to drive them, and the second link 26 is connected with the chain mechanism 120 so that the drive force of the motor 40 is distributed (transmitted) to the second link 26 through the first quadric-link mechanism 110 (or 210) and chain mechanism 120. The remaining configuration is the same as that in the fifth embodiment.

As stated above, the seventh embodiment is configured to the second link 26 is connected to a chain mechanism 120 and the drive force of the motor 40 is distributed to the second link 26 through the chain mechanism 120. With this, in addition to the foregoing effects, it is not necessary to take into account the intrinsic risk of the link mechanism like buckling, while the second link 26 can be displaced relative to the first link 22 more than 180 degrees, so that freedom of design can be enhanced. The remaining configuration is the same as that in the fifth and sixth embodiments.

Figure 27:
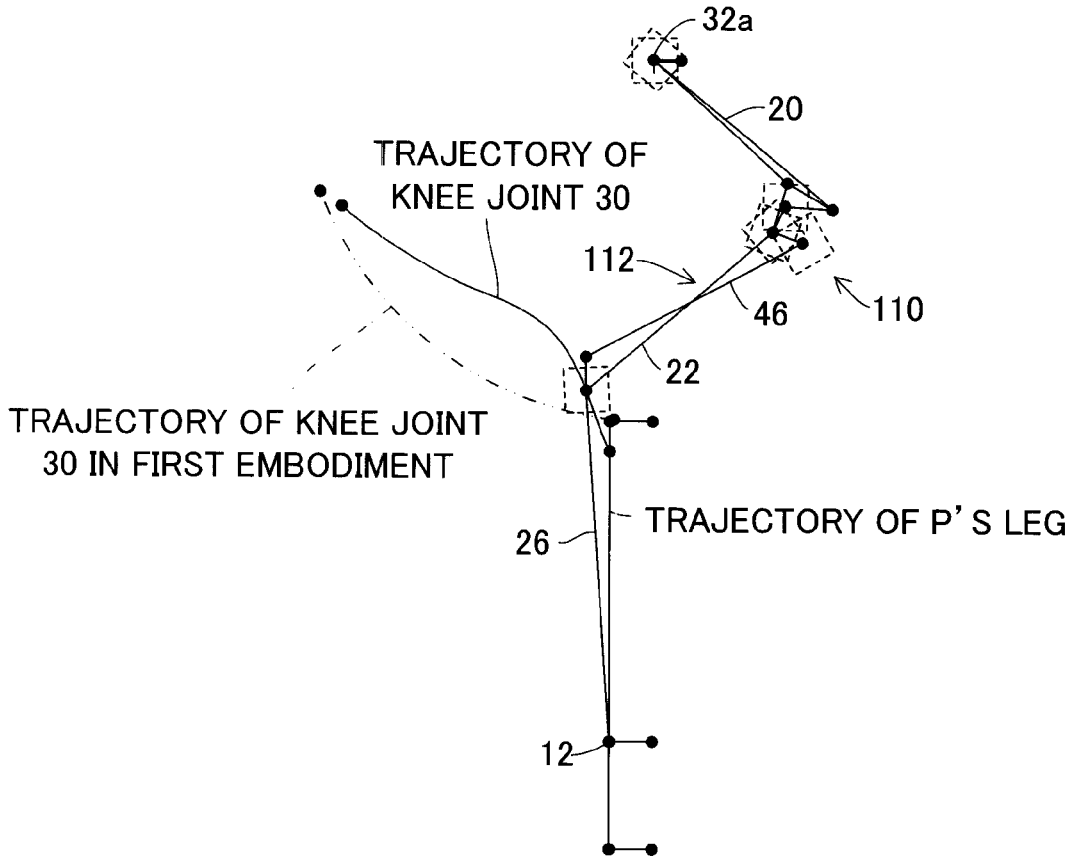
FIG. 27 is an explanatory view similar to FIG. 20, but showing an alternate example of the leg link of the device according to the fifth embodiment of the invention.
Figure 28:
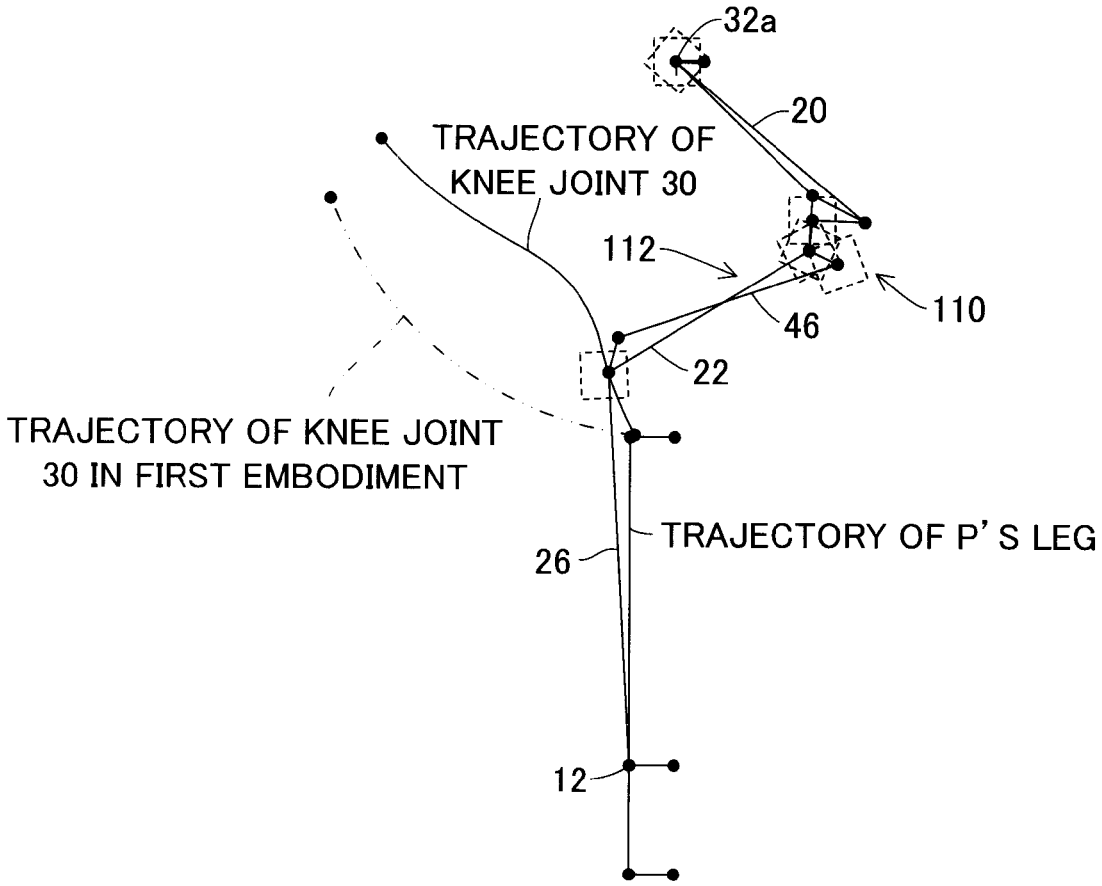
FIG. 28 is an explanatory view similar to FIG. 20, but showing another alternate example of the leg link of the device according to the fifth embodiment of the invention.
Figure 29:
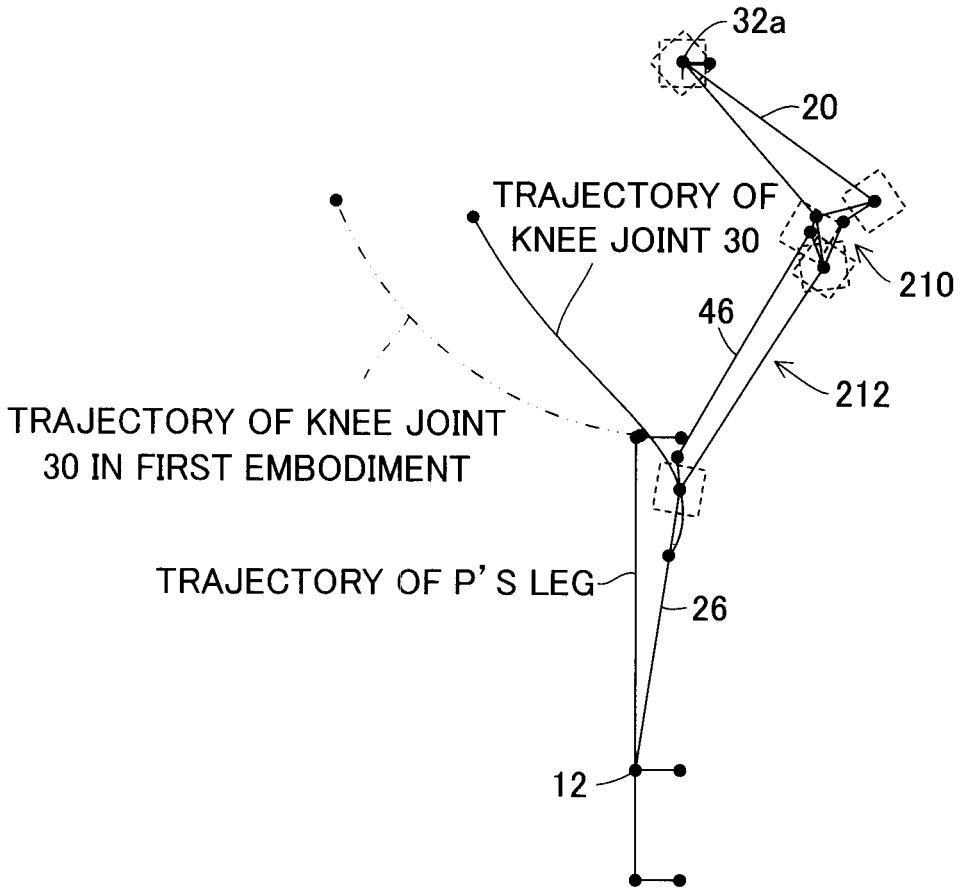
FIG. 29 is an explanatory view similar to FIG. 24, but showing an alternate example of the leg link of the device according to the sixth embodiment of the invention.

Note that, in the fifth and sixth embodiments, the length of the links constituting the first and second quadric-link mechanisms 110, 210, 112, 212 may be suitably changed. For instance, FIGS. 27 and 28 are alternate examples of the fifth embodiment and FIG. 29 is an alternate example of the sixth embodiment. This invention is applicable to such the alternate examples and this makes possible to vary the trajectory of the third joint (knee joint) 30 and the like as shown in the figures.

As mentioned in the foregoing, in the first to fourth embodiments, it is configured to have a walking assist device D having a support member (load transmitting member) 10 adapted to support a user P and transmit user's body weight, a pair of leg links 14 each connected to the support member 10 through a first joint 20 constituted of a swing mechanism to be swingable about a swing fulcrum 32*a* and having a first link 22 and a second link 26 connected to the first link 22 through a second joint (third joint 30), and actuators (electric motor) 40, each of the actuators 40 being operated to displace the first link 22 and the second link 26 relative to each other to produce an assist force that assists at least part of the user P's body weight so as to assist the user P to walk, characterized in that: a forward protruding amount of the second joint (third joint 30) to be protruded with change of an angle between the first link 22 and the second link 26 about the second joint (third joint 30) is changed.

Specifically, the device further includes a length reducing mechanism 70 adapted to reduce length d from the second joint (third joint 30, more precisely the joint shaft 30*a* thereof) to the swing fulcrum (center of curvature 32*a*) as the angle between the first link 22 and the second link 26 about the second joint (third joint 30) is decreased.

More specifically, the device further includes the length reducing mechanism 70 adapted to reduce the length d from the second joint (third joint 30, more precisely the joint shaft 30*a* thereof) to the swing fulcrum (center of curvature 32*a*) as the angle between the first link 22 and the second link 26 about the second joint (third joint 30) is decreased, such that the forward protruding amount of the second joint to be protruded with change of the angle between the first link 22 and the second link 26 about the second joint is changed.

Further, the first joint 20 includes an arc-shaped guide rail 32 fastened to the support member 10 and having its center of curvature 32*a* at the swing fulcrum and a slider 34 movably engaged with the guide rail 32, the leg link 14 is connected to the support member 10 to be swingable about the center of curvature 32*a* of the guide rail 32, and the actuator 40 is connected to a connecting rod 46 interconnecting the first joint 20 and the second link 26 in the first link 22.

Further, the length reducing mechanism 70 includes a slider gear 70*a* fastened to the slider 34, a link gear 70*b* meshed with the slider gear 70*a* and connected to the actuator 40, and a rocker arm 42 fastened at its one end with the link gear 70*b* and rotatably connected at its other end to the connecting rod 46, and the link gear 70*b* is driven by the actuator 40 to rotate the rocker arm 42 to move the connecting rod 46 backward (the length of the first link 22 is virtually reduced) such that the length d from the third joint 30 to the swing fulcrum is reduced.

Further, number of teeth of the slider gear 70*a* is larger than that of the link gear 70*b*.

In the second embodiment, the length reducing mechanism 70 includes one of components of a worm gear mechanism 86 having a worm 86*a* and a gear 86*b* fastened to the slider 34 and other thereof fastened to the connecting rod 46 and also connected to the actuator 40, and the other is driven by the actuator 40 to move the connecting rod 46 backward such that the length d from the third joint 30 to the swing fulcrum is reduced.

In the third embodiment, the length reducing mechanism 70 includes a guide 90 formed on the slider 34 and a second slider 92*a*, 92*b* movably engaged with the guide 90 and also fastened to the connecting rod 46, and the second slider 92*a*, 92*b* is driven by the actuator 40 to move the connecting rod 46 backward such that the length d from the third joint (more precisely the joint shaft 30*a* thereof) to the swing fulcrum (center of curvature 32*a*) is reduced.

In the fourth embodiment, the length reducing mechanism 70 includes a link mechanism 94 movably connecting the slider 34 with the connecting rod 46, and the link mechanism 94 is driven by the actuator 40 to move the connecting rod 46 backward such that the length d from the third joint 30 (more precisely the joint shaft 30*a* thereof) to the swing fulcrum (center of curvature 32*a*) is reduced.

In the fifth to seventh embodiments, it is configured to have a walking assist device D having a support member (load transmitting member) 10 adapted to support a user P and transmit user's body weight, a pair of leg links 14 each connected to the support member 10 through a first joint 20 constituted of a swing mechanism to be swingable about a swing fulcrum 32*a* and having a first link 22 and a second link 26 connected to the first link 22 through a second joint (third joint 30), and actuators (electric motor) 40, each of the actuators 40 being operated to displace the first link 22 and the second link 26 relative to each other to produce an assist force that assists at least part of the user P's body weight so as to assist the user P to walk, wherein the leg link 14 includes a third link 100, 200 connected to the first joint 20, and the third link 100, 200 and the first link 22 are interconnected by a third joint (fourth joint) 102, 202 to be movable relative to each other.

More specifically, the leg link 14 includes the third link 100, 200 connected to the first joint 20, and the third link 100, 200 and the first link 22 are interconnected by the third joint (fourth joint) 102, 202 to be movable relative to each other, such that the forward protruding amount of the second joint to be protruded with change of the angle between the first link 22 and the second link 26 about the second joint (third joint) 30 is changed.

Further, movement of the second joint 30 describes trajectory having at least one inflection point Pi as viewed from side when the actuator (electric motor) 40 is operated to displace the first link 22 and second link 26 relative to each other.

Further, length from the second joint 30 to the swing fulcrum 32*a* is changed in line with trajectory having nonlinear characteristics as viewed from side as the angle (knee joint angle) between the first link 22 and the second link 26 about the second joint 30 is decreased when the actuator (electric motor) 40 is operated to displace the first link 22 and second link 26 relative to each other.

The device further includes a fourth link (bell crank 104, crank 204) connected to the first link 22 and a fifth link (connecting rod 106, 206) connected at its one end to the fourth link and at other end to the third link 100, 200, and a quadric-link mechanism 110, 210 constituted of the first, third, fourth and fifth links is driven by the actuator.

Further, the quadric-link mechanism 110, 210 establishes a dead point at which at least three (rotary shaft 100*b*1 of the rocker arm 100*b*, rotary shaft 104*c*1 of the one crank 104*c* of the bell crank, rotary shaft 104*d*1 of the other crank 104*d* of the bell crank 104, rotary shaft 200*b*1 of the rocker arm 200*b*, rotary shaft 204*a* of the crank 204, other rotary shaft 204*b* of the crank 204) of kinematic pair points are positioned in a straight line.

Further, a drive force of the actuator 40 is distributed to the first link 22 and the second link 26 to drive them.

Further, the second link 26 is connected to a second quadric-link mechanism 112, 212 and the drive force of the actuator 40 is distributed to the second link 26 through the second quadric-link mechanism.

In the seventh embodiment, the second link 26 is connected to a chain mechanism 120 and the drive force of the actuator 40 is distributed to the second link 26 through the chain mechanism 120.

Further, the second quadric-link mechanism 112, 212 shares at least one (rotary shaft 104*b* of the bell crank 104, rotary shaft 200*b*1 of the rocker arm 200*b* (and connecting rod 206)) of kinematic pair points with the first quadric-link mechanism 110, 210.

Although explained using the embodiments, the invention is not limited to the embodiments and various modifications are possible. For example, the length reducing mechanism 70 comprises the gear mechanism, worm gear mechanism or the like in the first to fourth embodiments but it should not be limited thereto.

In the first to seventh embodiments, although the actuator is exemplified by the electric motor 40, it should not be limited thereto.

Although the output shaft of the motor 40 is located at the bell crank 104 in the fifth embodiment and at the rotary shaft of the crank 204 in the sixth embodiment, the invention can be modified in the various manners, including the location of the output shaft of the motor 40.

INDUSTRIAL APPLICABILITY

According to this invention, in a walking assist device having a pair of leg links each connected to a support member through a first joint and having a first link and a second link connected to the first link through a second joint, and actuators, each of the actuators being operated to displace the first link and the second link relative to each other to produce an assist force that assists at least part of user's body weight so as to assist the user to walk, a forward protruding amount of the second joint to be protruded with change of an angle between the first link and the second link about the second joint is changed. With this, where the second joint is corresponding to the knee joint, it becomes possible to change, i.e., decrease the forward protruding amount of the second joint to be protruded from the trunk of the user with change of the angle about the second joint, thereby decreasing the inertia force about the vertical axis, while mitigating the unnatural impression of the appearance.

DESCRIPTION OF SYMBOLS

D Walking assist device, 10 Support member, 10*a* Seat, 10*b* Support frame, 10*c* Back rest, 10*d* Grip, 12 Shoe unit, 12*a* Shoe, 12*b* Connecting member, 12*c* Insole, 14 Leg link, 16 Drive mechanism, 20 First joint, 22 First link, 24 Second joint, 26 Second link, 30 Third joint, 32 Guide rail, 32*a* Center of curvature (swing fulcrum), 34 Slider, 36 Roller, 40 Actuator (electric motor), 40*a* Speed reducer, 40*b* Output shaft, 42 Rocker arm, 44 Driven crank arm, 46 Connecting rod, 50 Battery, 60 Pressure sensor, 62 Force sensor, 64 Controller, 70 Length reducing mechanism, 70*a* Slider gear, 70*b* Link gear, 72 Linear motion shaft, 72*a* Helical thread groove, 74 Ball screw mechanism, 74*a* Nut member, 76 Case, 76*a* Main case, 76*b* Side case, 80 Support shaft, 82 Cylindrical member, 84 Belt pulley mechanism, 84*a* Drive pulley, 84*b* Driven pulley, 84*c* Belt, 86 Worm gear mechanism, 86*a* Worm, 86*b* Gear, 90 Guide, 92 Second slider, 94 Link mechanism, 94*a* Third link, 94*b* Fourth link, 100, 200 Third link, 100*a*, 200*a* Link member, 100*b*, 200*b* Rocker arm, 102, 202 Fourth joint (third joint), 104 Bell crank, 104*a* Ball bearing, 104*b* Rotary shaft, 104*c* One crank, 104*d* Other crank, 204 Crank, 106, 206 Connecting rod, 110, 210 First quadric-link mechanism, 112, 212 Second quadric-link mechanism, 120 Chain mechanism, 122 Idler

The invention claimed is:

1. A walking assist device comprising:

a support member, a pair of leg links, and actuators;

the support member adapted to support a user and transmit user's body weight, the pair of leg links each connected to the support member to be swingable about a swing fulcrum through a first joint constituted of a swing mechanism, and each of the pair of leg links having a first link and a second link, wherein the second link of each of the leg links is connected to the first link of each of the leg links through a second joint, each of the actuators for each leg link being operated to displace the first link and the second link relative to each other to produce an assist force that assists at least part of the user's body weight so as to assist the user to walk, wherein the improvement comprises:

a length reducing mechanism for each leg link and adapted to reduce length from the second joint to the swing fulcrum as an angle between the first link and the second link about the second joint is decreased, wherein the first joint of each leg link includes an arc-shaped guide rail fastened to the support member, the guide rail having a center of curvature at the swing fulcrum, and a slider movably engaged with the guide rail, each leg link is connected to the support member to be swingable about the center of curvature of the guide rail, and each actuator of each leg link is connected to a connecting rod in the first link of each leg link, the connecting rod interconnecting the first joint and the second link of each leg link, wherein the length reducing mechanism for each leg link includes a slider gear fastened to the slider, a link gear meshed with the slider gear and connected to the actuator for each leg link, and a rocker arm, one end of the rocker arm fastened with the link gear and the other end of the rocker arm rotatably connected to the connecting rod, and the link gear is driven by the actuator to rotate the rocker arm to move the connecting rod backward such that the length from the second joint to the swing fulcrum is reduced.

2. The device according to claim 1, wherein number of teeth of the slider gear is larger than that of the link gear.

* * * * *